United States Patent [19]

Kashiwaya et al.

[11] Patent Number: 4,528,964

[45] Date of Patent: Jul. 16, 1985

[54] FUEL INJECTION CONTROL APPARATUS FOR INTERNAL COMBUSTION ENGINE

[75] Inventors: Mineo Kashiwaya; Kiyomi Morita; Masahide Sakamoto, all of Katsuta, Japan

[73] Assignee: Hitachi, Ltd., Tokyo, Japan

[21] Appl. No.: 543,983

[22] Filed: Oct. 20, 1983

[30] Foreign Application Priority Data

Oct. 20, 1982 [JP] Japan ..... 57-182905

[51] Int. Cl.[3] ..... F02D 5/00

[52] U.S. Cl. ..... 123/492; 123/480

[58] Field of Search ..... 123/492, 480

[56] References Cited

U.S. PATENT DOCUMENTS

| | | | |
|---|---|---|---|
| 4,184,458 | 1/1980 | Aoki et al. | 123/492 |
| 4,245,605 | 1/1981 | Rice et al. | 123/492 |
| 4,266,275 | 5/1981 | Marchak | 123/492 |
| 4,440,119 | 4/1984 | Kobayashi et al. | 123/492 |

*Primary Examiner*—Andrew M. Dolinar

*Attorney, Agent, or Firm*—Antonelli, Terry & Wands

[57] ABSTRACT

A fuel injection control apparatus for an internal combustion engine for supplying an additional amount of fuel in addition to a basic amount of fuel when an acceleration condition is detected in accordance with a throttle opening change rate. The amount of additional fuel injection is increased in acceleration so as to prevent the fuel air mixture from being lean in acceleration.

2 Claims, 36 Drawing Figures

FIG. 7

| TASK LEVEL | $2^7$ | | | | | $2^2$ | $2^1$ | $2^0$ |
|---|---|---|---|---|---|---|---|---|
| "0" | $R_0$ | | | | | $Q_2$ | $Q_1$ | $Q_0$ |
| "1" | $R_1$ | | | | | $Q_2$ | $Q_1$ | $Q_0$ |
| "2" | $R_2$ | | | | | $Q_2$ | $Q_1$ | $Q_0$ |

FIG. 8

| START ADDRESS | |
|---|---|
| SA0 | START ADDRESS FOR TASK NO. 0 |
| SA1 | START ADDRESS FOR TASK NO. 1 |
| SA2 | START ADDRESS FOR TASK NO. 2 |
| | |
| | |
| SA7 | START ADDRESS FOR TASK NO. 7 |
| SA8 | START ADDRESS FOR TASK NO. 8 |

FUEL INJECTION CONTROL APPARATUS FOR INTERNAL COMBUSTION ENGINE

CROSS REFERENCE OF RELATED APPLICATIONS

This application relates to the subject matter of a copending U.S. application Ser. No. 471,435 filed on Mar. 2, 1983.

The present invention relates to a fuel control apparatus employing a microcomputer, and, more particularly, to a fuel injection apparatus in which additional fuel for acceleration compensation is injected in accordance with the state of acceleration detected on the basis of the opening of a throttle valve.

Recently, general control for an engine is performed by using a microcomputer for the purpose of improvement in engine control performance.

Various functions are required for the engine control depending on the kind or type/use of car, and therefore, in the engine control system utilizing a microcomputer, a general purpose software, that is a software in which correction, modification or addition can be effected onto the various control functions depending on the kind/use of car, is required in view of improvement in cost and/or in controllability.

Conventionally, the amount of suction air in an engine has been indirectly detected on the basis of the pressure in a suction manifold, or the total amount of suction air per suction stroke has been obtained by directly detecting the air flow rate. In the former, since it is a indirect method, there is a disadvantage that the accuracy is poor, the variations and/or deterioration in performance of the engine may affect the detection, and the responsibility is not so good. The latter method also has a disadvantage in that a flow rate sensor having high accuracy (error: within +1% of read value) and a wide dynamic range (1:50) is required, resulting in increase in cost. It is preferable to use a so-called hot-wire type flow rate sensor (hereinafter referred to as a hot-wire sensor) as the flow rate sensor, because the hot-wire sensor has a characteristic allowing a wide dynamic range and reduction in cost can be expected.

However, the suction air flow rate in an engine is not constant, but has pulsations, so that the output signal from a flow rate sensor has a non-linear characteristic with respect to the suction air flow. Therefore, it becomes necessary to obtain the air flow rate during the suction stroke in the form of an integration of instantaneous air flow rates, and complex operations are required for the integration. That is, the hot-wire output voltages v shown in FIG. 1 can be obtained according to the following equation (1):

$$v = \sqrt{C_1 + C_2\sqrt{q_A}} \tag{1}$$

where $q_A$ represents the mass flow rate and $C_1$, $C_2$ represent constants determined by the shape of intake manifold etc. This equation (1) can be changed into the following equation (2):

$$v^2 = C_1 + C_2\sqrt{q_A} \tag{2}$$

Assuming now that $v = v_0$ when the rotational number of engine $N=0$ and the mass flow rate $q_A=0$, the equation (2) is expressed as follows:

$$v_0^2 = C_1 \tag{3}$$

Thus, the following equations (4) and (5) are derived from the equations (2) and (3) and an instantaneous value of mass flow rate $q_A$ can be obtained from the equation (5).

$$v^2 = v_0^2 + C_2\sqrt{q_A} \tag{4}$$

$$q_A = \frac{1}{C_2^2}(v^2 - v_0^2)^2 \tag{5}$$

Thus, the average or mean air flow rate in one suction stroke $Q_A$ can be expressed as follows:

$$Q_A = \frac{q_{A1}\cdot\Delta\theta + q_{A2}\cdot\Delta\theta + \ldots q_{An}\cdot\Delta\theta}{n\cdot\Delta\theta} = \frac{\sum_{n=1}^{n} q_{An}}{n} \tag{6}$$

where $\Delta\theta$ represents a crank angle between two adjacent sampling points of $q_A$.

Further, the amount of fuel injection $Q_F$ for one suction stroke can be expressed by the following equation (7):

$$Q_F = kQ_A/N \tag{7}$$

where N represents the number of engine revolution and k a constant. This means that the amount of fuel injection $Q_F$ for one stroke can be determined on the basis of the obtained value of $Q_A$ and the number of engine revolution N.

Although the basic fuel injection amount $Q_F$ can be obtained in such a manner as described above, acceleration can not be smoothly effected by using only the thus obtained basic fuel injection amount $Q_F$ when acceleration becomes necessary, because of delay in computation of the value $Q_A$, etc. It has been effected, therefore, to compensate the basic fuel injection amount in accordance with the detection of the state of acceleration on the basis of the change in the take-in amount of $Q_A$. However, the suction air flow rate $Q_A$ has pulsations as described above and an error may occur in detection of the state of acceleration. This applies to the case of decelerating operation. Therefore, the state of acceleration or deceleration is detected on the basis of the detection of the opening of the throttle valve. That is, the throttle opening TH is sampled at a predetermined regular interval of time, for example every 10 msec, (by interval interruption) so that the sampling value TH at present is compared every 10 msec with the sampling value TH(OLD) sampled before 30 msec to obtain the difference ΔTH therebetween and judgement is made such that the engine is in the state of acceleration when $\Delta TH > 0$.

In response to the detection of this state of acceleration, additional fuel for the compensation for acceleration is additionally injected. Such a system for detecting the acceleration and injecting the additional fuel is shown in Japanese Patent Publication No. 49-45653 and U.S. Pat. No. 3,898,962.

The throttle is opened in case of acceleration to thereby accelerate the engine. The throttle opening change rate during acceleration is generally large at the beginning of the acceleration and becomes smaller near the end thereof. However, during acceleration, the suction air flow rate does not increase promptly in proportion to the increase of the throttle opening due to the inertia of the suction air. Thus, the suction air flow rate increases with a change rate larger than the change rate of the throttle opening near the end of acceleration. Therefore, the suction air flow rate is relatively large near the end of acceleration when compared with the amount of additional fuel injection which is determined on the basis of the throttle opening change rate, so that the fuel air mixture becomes lean near the end of acceleration to thereby impair the acceleration.

Further, the change rate of the suction air flow rate in case of changing the throttle opening by a pregiven value ΔTH from a small opening position or an idle operation position is larger than the change rate in case of changing the throttle opening by the pregiven value ΔTH from a partially opened position. Thus, if the additional fuel injection amount To is determined only on the basis of the throttle opening change rate ΔTH, in the acceleration from the idle operation position or the small opening position of the throttle valve, the fuel-air mixture is likely to be lean near the start of acceleration to thereby cause the shortage of acceleration near the start of acceleration.

An object of the present invention is to provide a fuel injection apparatus for an internal combustion engine which can accelerate smoothly near the start or end of acceleration.

According to an aspect of the present invention, a throttle opening change rate is detected successively with a pregiven period, an amount of additional fuel injection for acceleration is determined in accordance with the throttle opening change rate, and the amount of additional fuel injection is increased near the start or end of acceleration so as to prevent the fuel air mixture supplied to said engine from being lean near the start or end of acceleration.

The above and other objects, features and advantages of the present invention will be more clear from the following description with reference to the accompanying drawings, in which:

FIG. 7 is a diagram showing a table of task control blocks provided in RAM controlled by a task dispatcher;

FIG. 8 is a diagram showing a start address table for the tasks actuatable by various interruptions;

Figure 17:
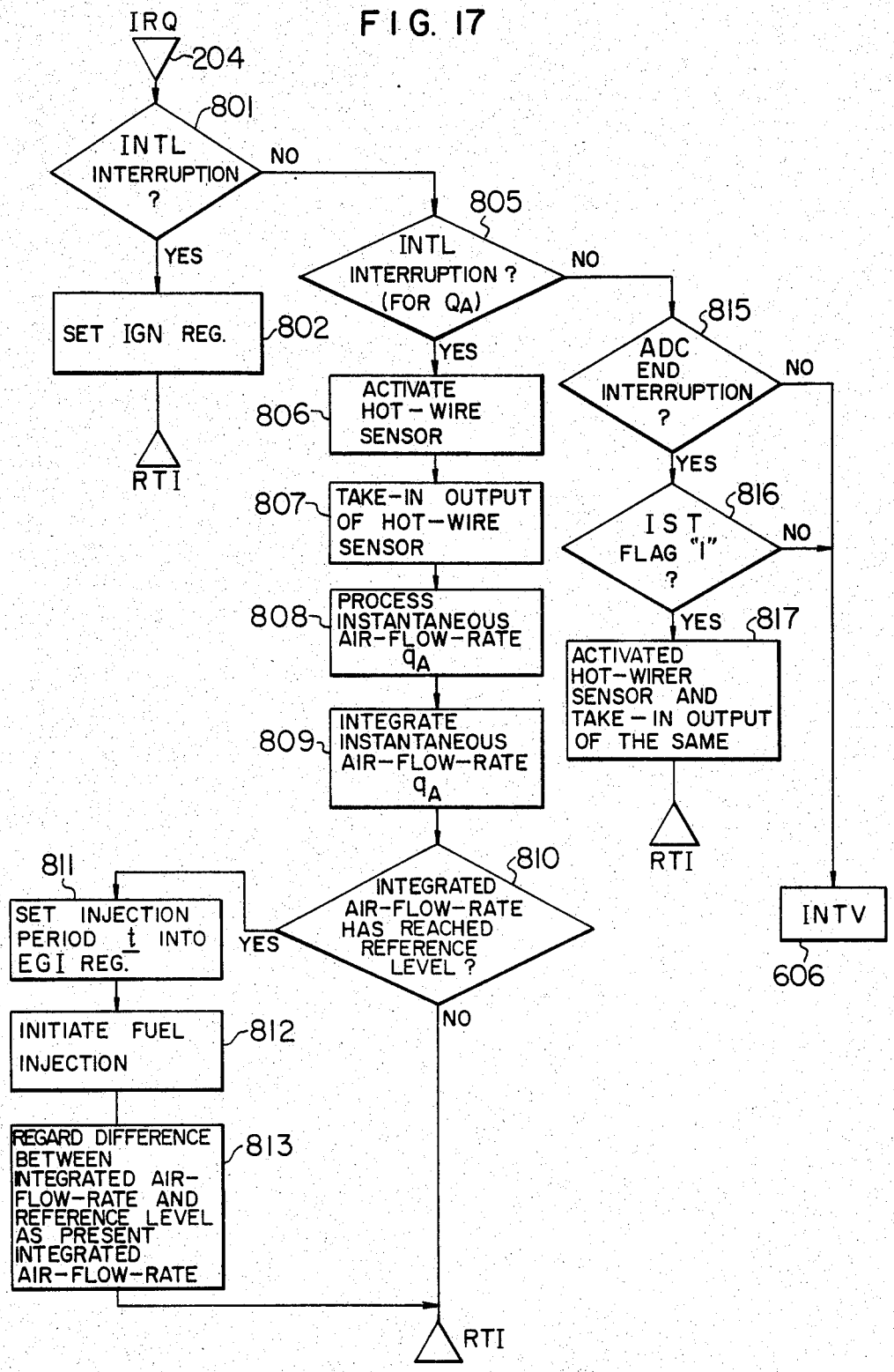
Figure 18:
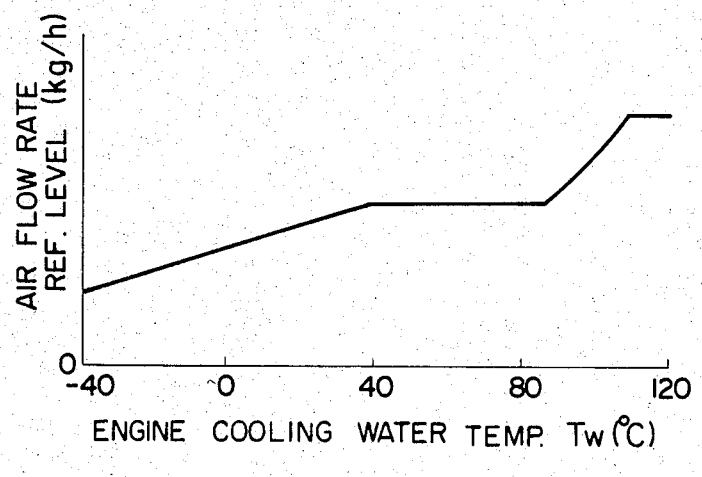
Figure 19:
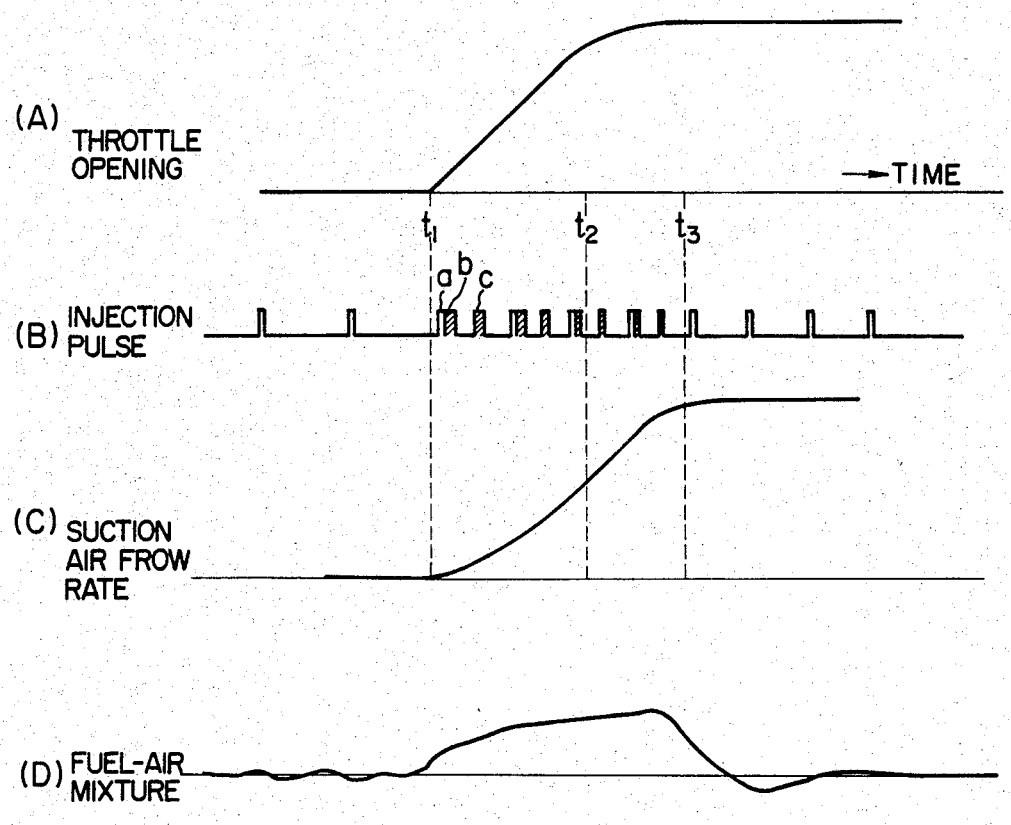
Figure 20:
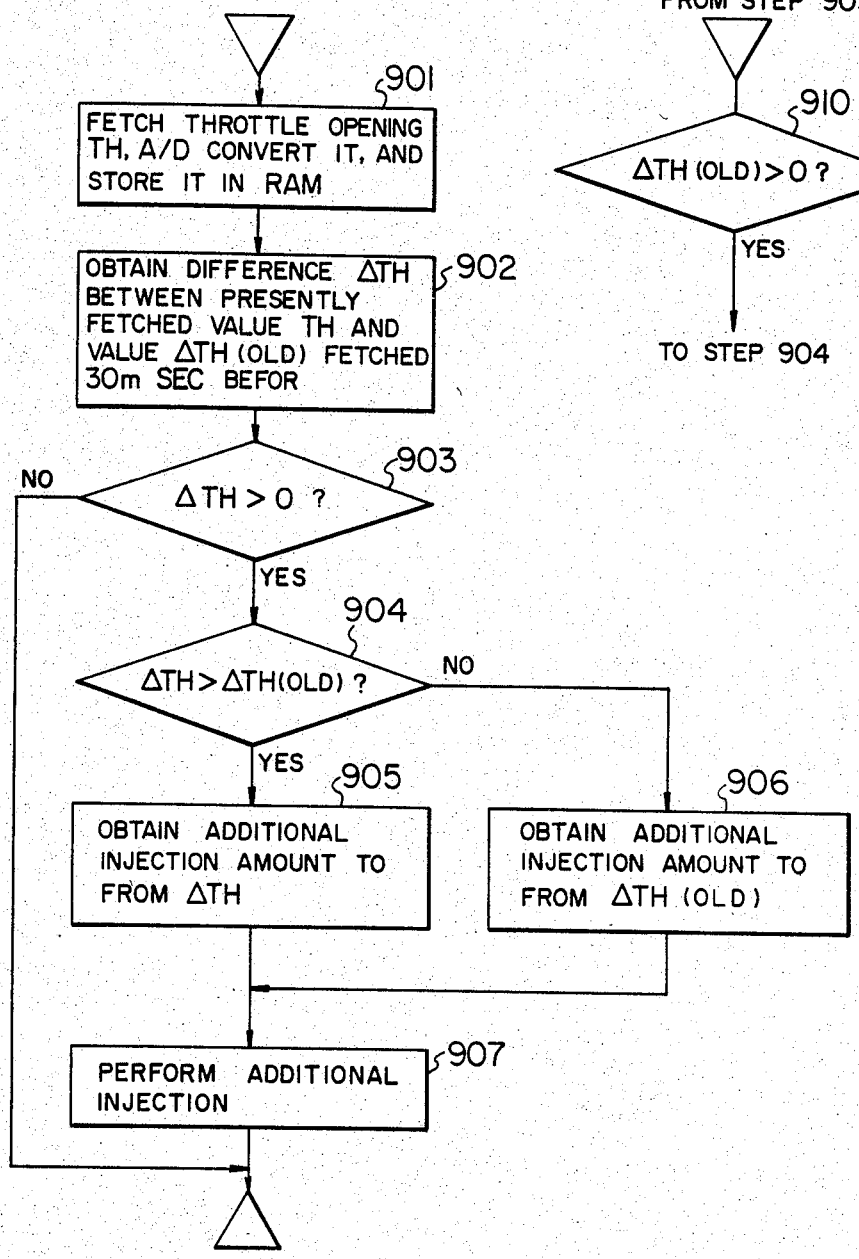
Figure 22:
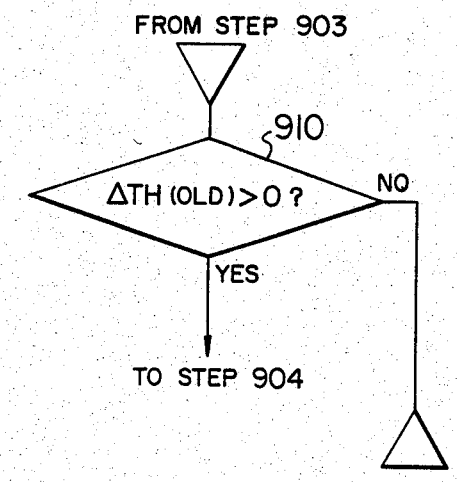
Figure 23:
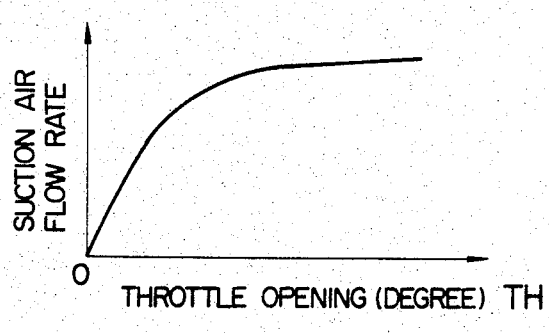
Figure 24:
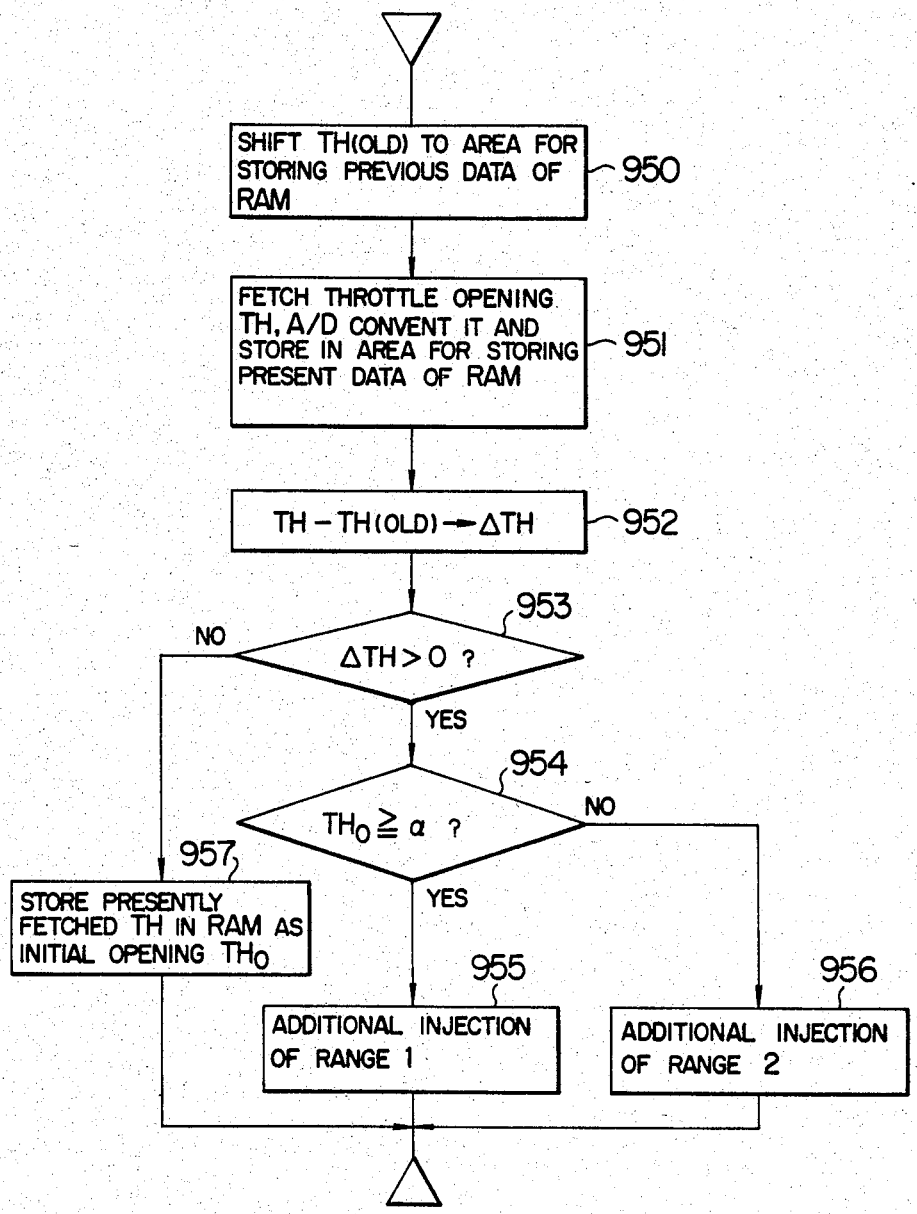
Figure 25:
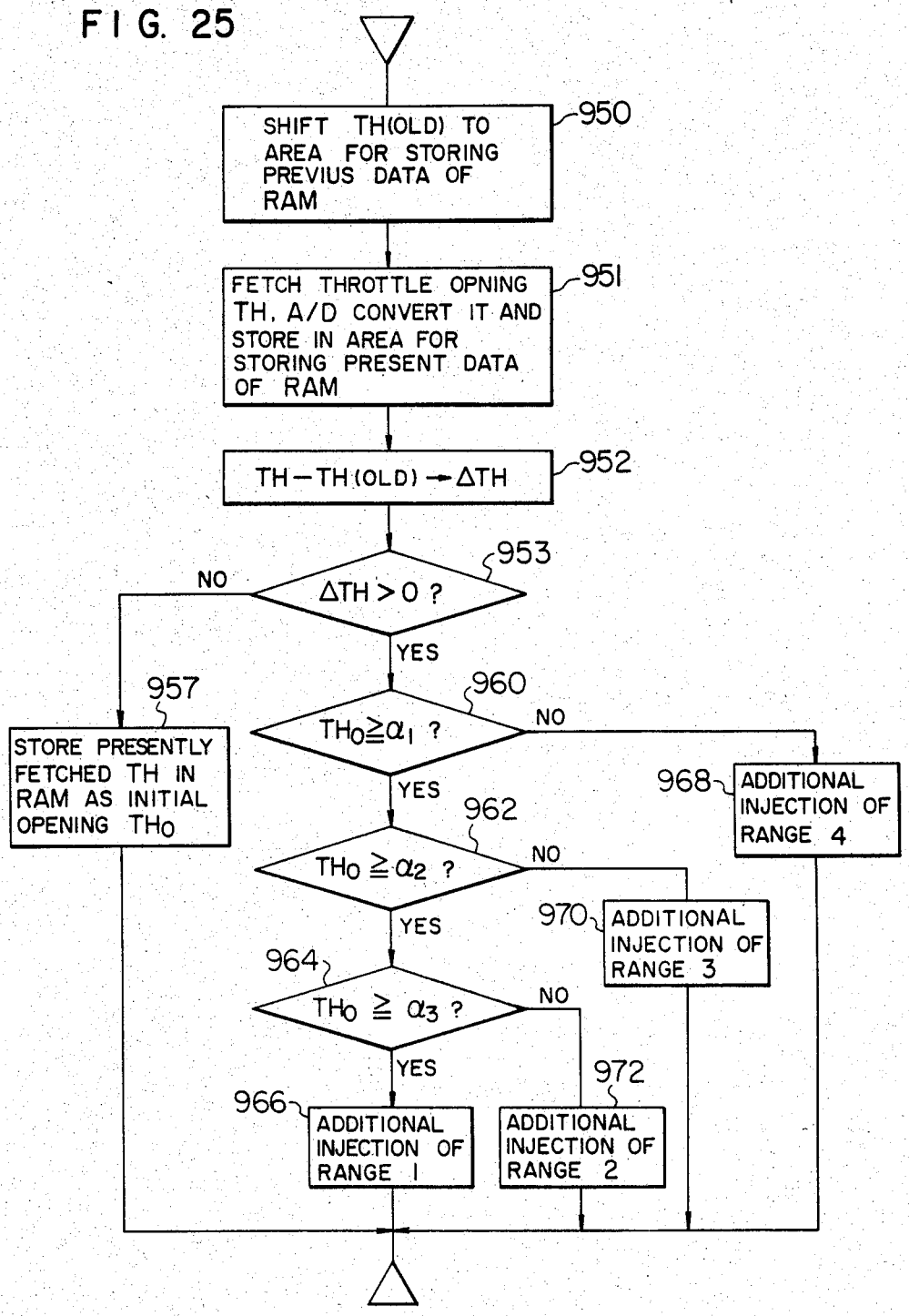

FIGS. 16(A)–(C) is a diagram showing the relation between the suction air flow rate and the injection timing in the fuel injection system to which the present invention is applied;

FIG. 17 is a flowchart for processing interruptions;

FIG. 18 is a diagram showing the alteration of an air flow rate reference value with respect to the temperature of engine cooling water;

FIGS. 19(A)–(D) a diagram showing the relation among the throttle opening, the injection pulse, suction air flow rate, and the state of fuel air mixture, during acceleration;

FIG. 20 is a flow chart showing an embodiment of the present invention for executing fuel control during acceleration;

FIGS. 21(A)–(C) is a time chart showing the state of the engine in the fuel injection control processing of FIG. 20;

FIG. 22 is a flowchart showing another embodiment of the present invention;

FIG. 23 is a graph illustrating a relation between the throttle opening and the suction air flow rate;

FIGS. 24 and 25 are flowcharts showing other embodiments of the present invention.

Figure 26:
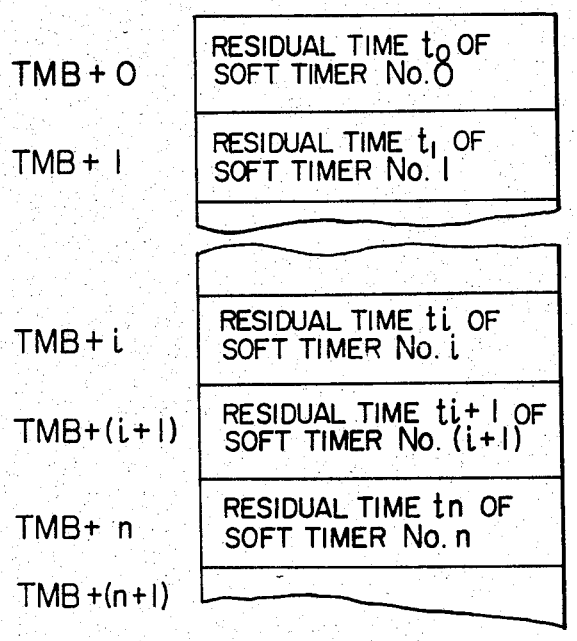
Figure 27:
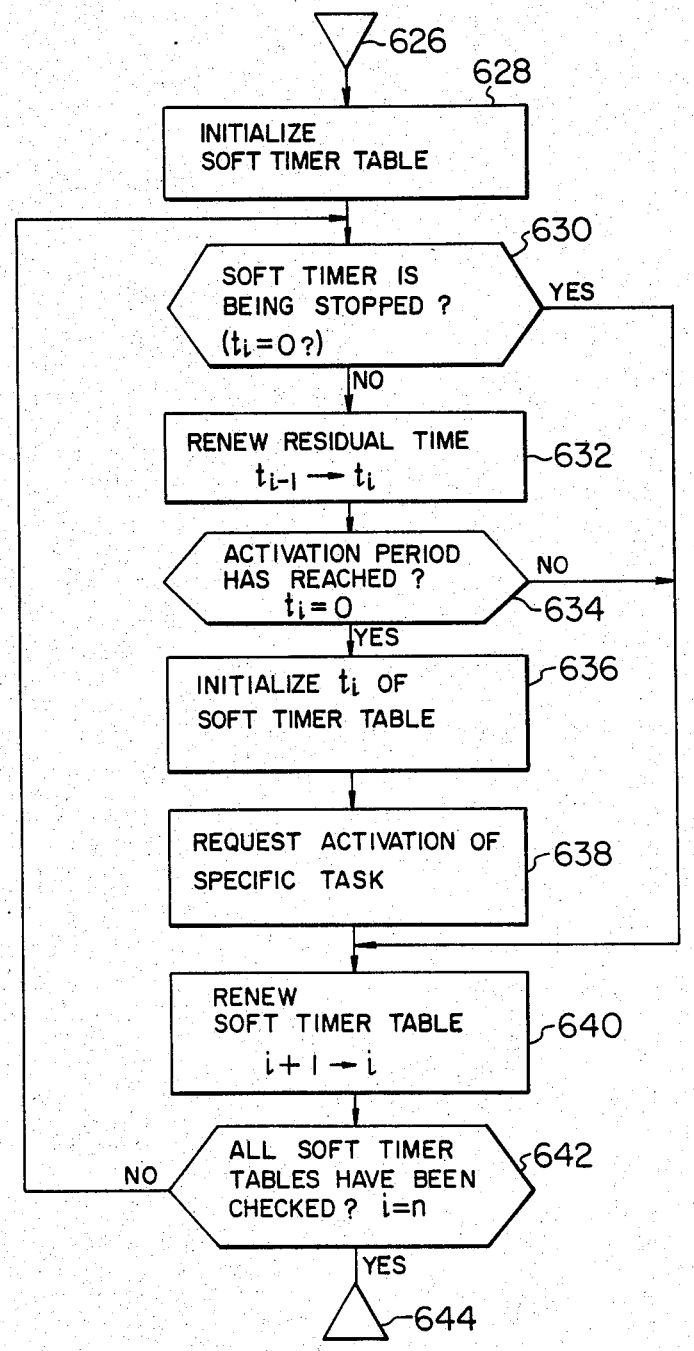
Figure 28:
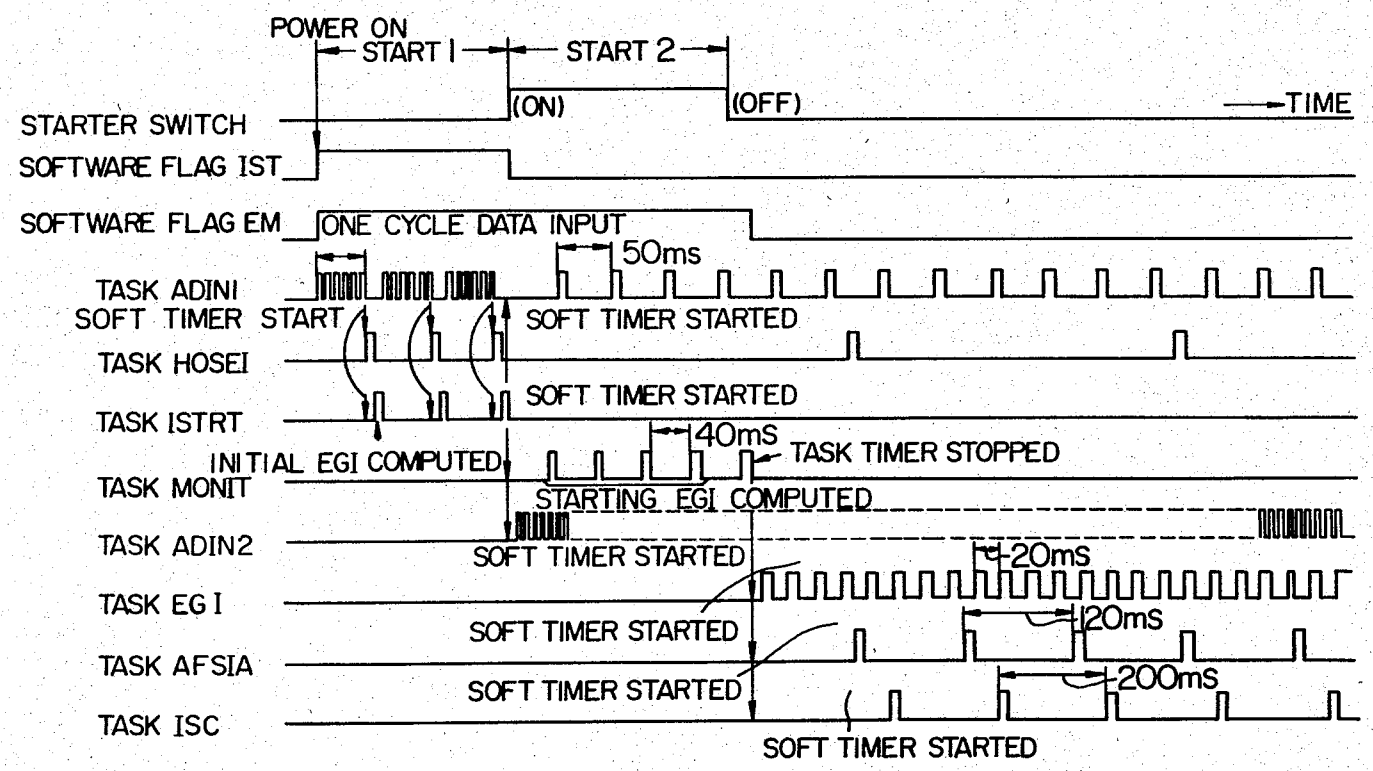
Figure 29:
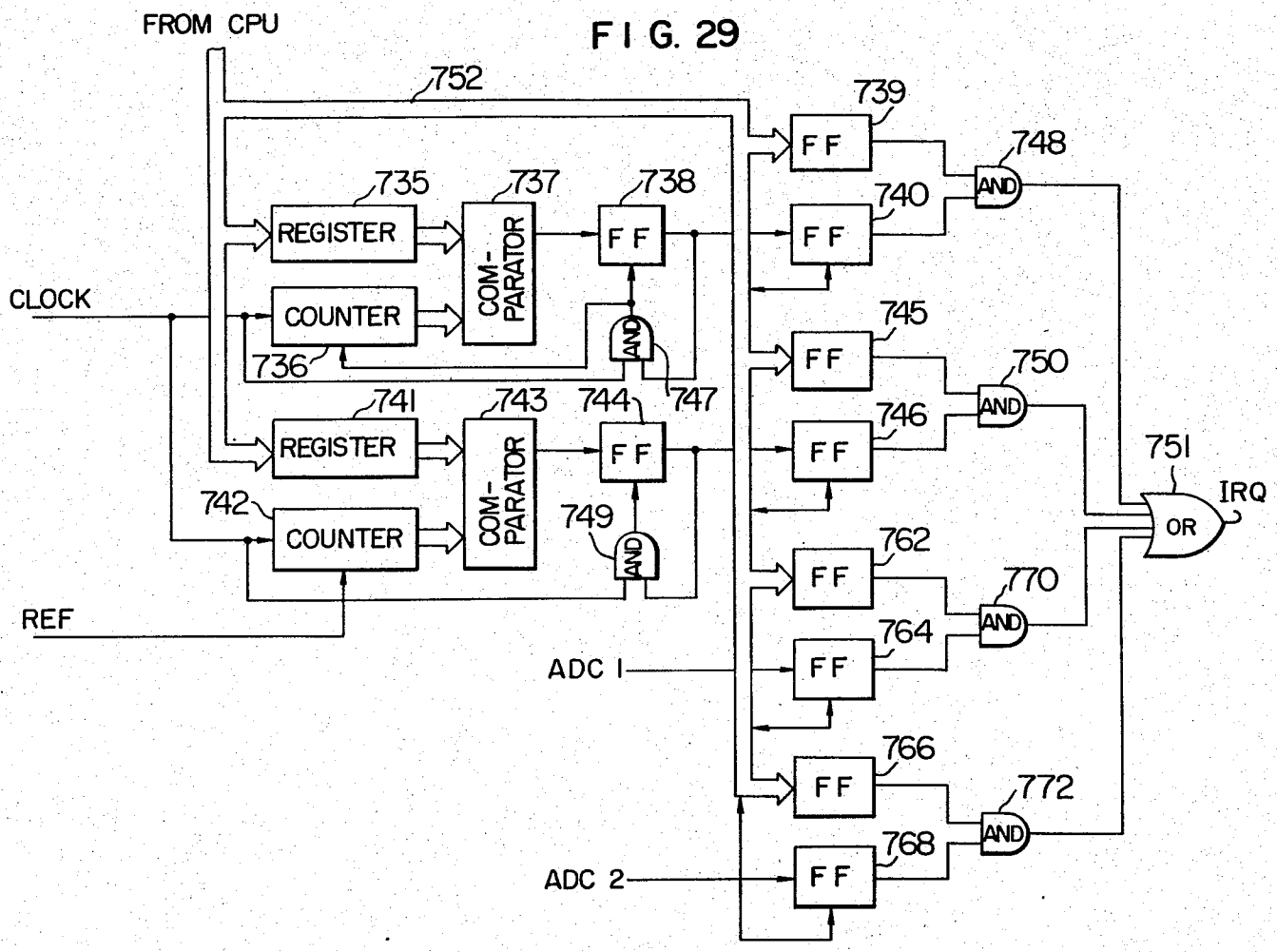

FIG. 26 is a diagram showing a soft timer table provided in RAM;

FIG. 27 is a flowchart for executing the processing of interval (INTV) interruption;

FIG. 28 is a time chart showing various states of start/stoppage of various tasks effected in accordance with the engine state; and FIG. 29 is a block diagram of the interruption request (IRQ) generating circuit.

Referring to the drawings, preferred embodiments of the present invention will be described hereunder.

Figure 1:
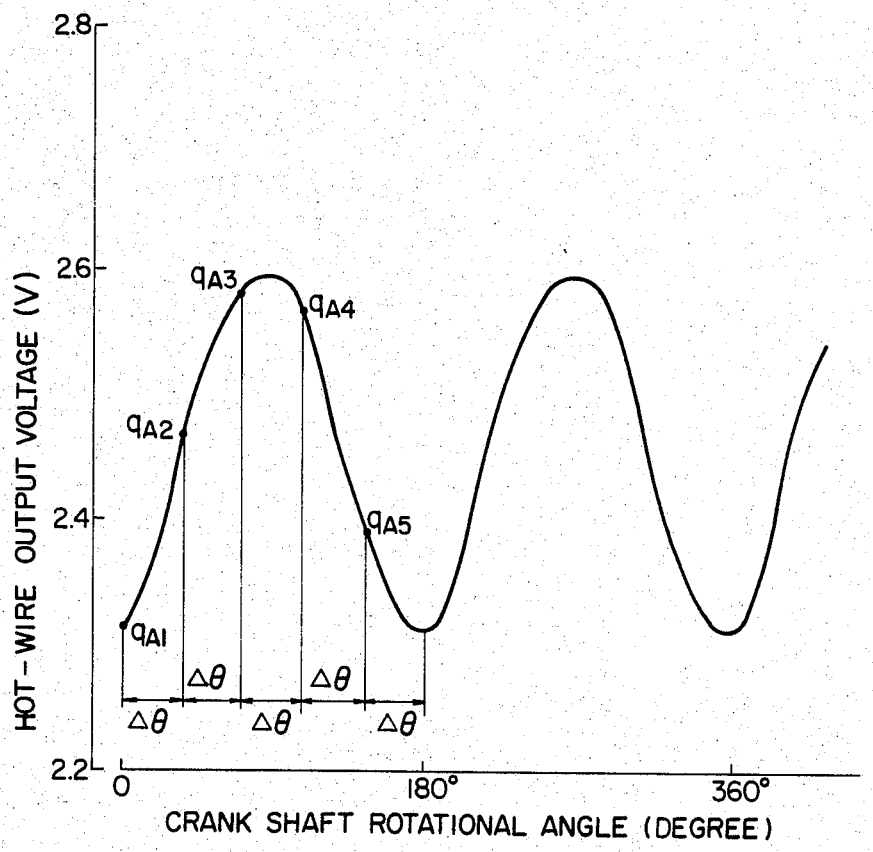
FIG. 1 is a characteristic diagram of the hot-wire sensor output voltage v with respect to the crank shaft rotational angle.
Figure 2:
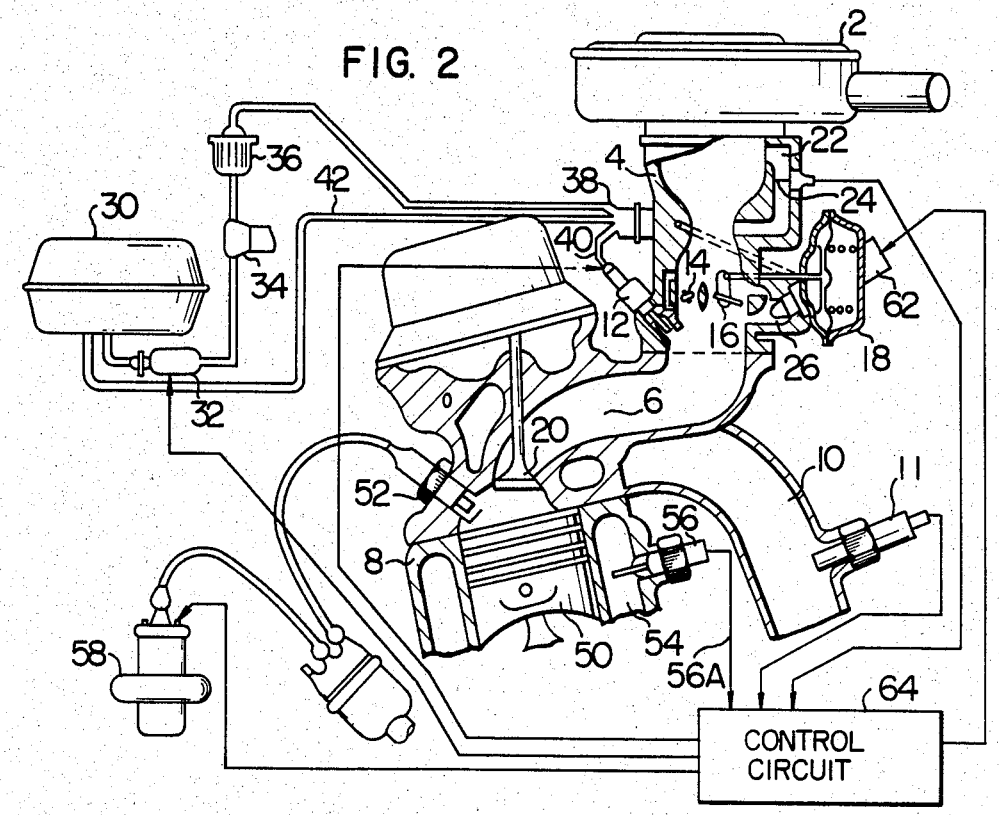
FIG. 2 is a schematic diagram of the control device for the whole of the engine system.

In FIG. 2, a control apparatus for the whole of an engine system is illustrated. In FIG. 2, suction air is supplied to a cylinder 8 through an air cleaner 2, a throttle chamber 4, and a suction pipe 6. A gas burnt in the cylinder 8 is discharged from the cylinder 8 to the atmosphere through an exhaust pipe 10. An injector 12 for injecting fuel is provided in the throttle chamber 4. The fuel injected from the injector 12 is atomized in an air path of the throttle chamber 4 and mixed with the suction air to form a fuel-air mixture which is in turn supplied to a combustion chamber of the cylinder 8 through the suction pipe 6 when a suction valve 20 is opened.

Throttle valves 14 and 16 are provided in the vicinity of the output of the injector 12. The throttle valve 14 is arranged so as to mechanically interlocked with an accelerator pedal (not shown) so as to be driven by the driver. The throttle valve 16 is arranged to be driven by a diaphragm 18 such that it becomes its fully close state in a range where the air flow rate is small, and as the air flow rate increases the negative pressure applied to the diaphragm 18 also increases so that the throttle valve 16 begins to open, thereby suppressing the increase of suction resistance.

An air path 22 is provided at the upper stream of the throttle valves 14 and 16 of the throttle chamber 4 and an electrical heater 24 constituting a thermal air flow rate meter is provided in the air path 22 so as to derive from the heater 24 and electric signal which changes in accordance with the air flow velocity which is determined by the relation between the air flow velocity and the amount of heat transmission of the heater 24. Being provided in the air path 22, the heater 24 is protected from the high temperature gas generated in the period of back fire of the cylinder 8 as well as from the pollution by dust or the like in the suction air. The outlet of the air path 22 is opened in the vicinity of the narrowest portion of the venturi and the inlet of the same is opened at the upper stream of the venturi.

Figure 5:
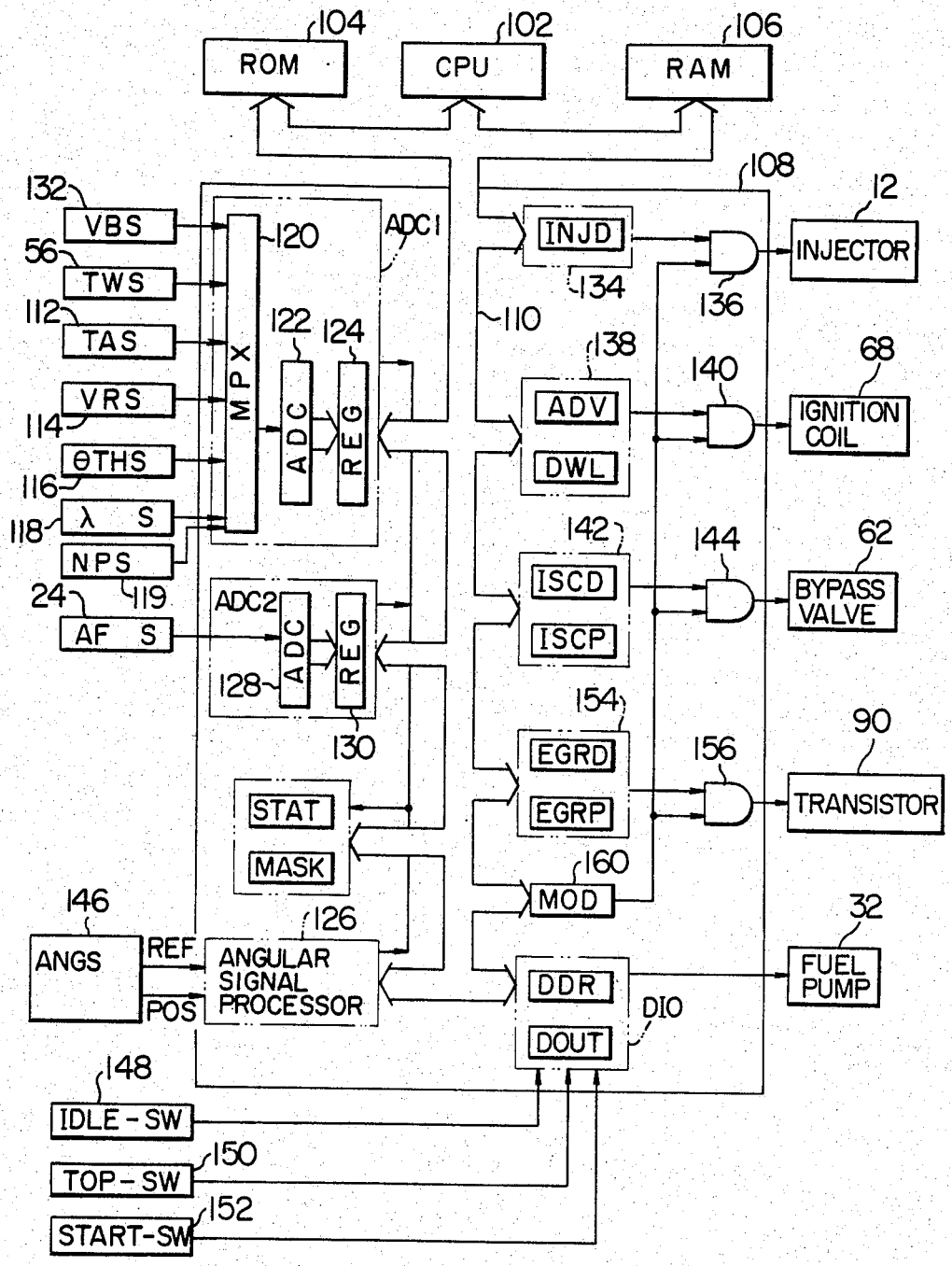
FIG. 5 is a block diagram generally illustrating the engine control system.

Throttle opening sensors (not shown in FIG. 2 but generally represented by a throttle opening sensor 116 in FIG. 5) are respectively provided in the throttle valves 14 and 16 for detecting the opening thereof and the detection signals from these throttle opening sensors, that is the sensor 116, are taken into a multiplexer 120 of a first analog-to-digital converter as shown in FIG. 5.

The fuel to be supplied to the injector 12 is first supplied to a fuel pressure regulator 38 from a fuel tank 30 through a fuel pump 32, a fuel damper 34, and a filter 36. Pressurized fuel is supplied from the fuel pressure regulator 38 to the injector 12 through a pipe 40 on one hand and fuel is returned on the other hand from the fuel pressure regulator 38 to the fuel tank 30 through a return pipe 42 so as to maintain constant the difference between the pressure in the suction pipe 6 into which fuel is injected from the injector 12 and the pressure of the fuel supplied to the injector 12.

The fuel-air mixture sucked through the suction valve 20 is compressed by a piston 50, burnt by a spark produced by an ignition plug 52, and the combustion is converted into kinetic energy. The cylinder 8 is cooled by cooling water 54, the temperature of the cooling water is measured by a water temperature sensor 56, and the measured value is utilized as an engine temperature. A high voltage is applied from an ignition coil 58 to the ignition plug 52 in agreement with the ignition timing.

A crank angle sensor (not shown) for producing a reference angle signal at a regular interval of predetermined crank angles (for example 180 degrees) and a position signal at a regular interval of a predetermined unit crank angle (for example 0.5 degrees) in accordance with the rotation of engine, is provided on a not-shown crank shaft.

The output of the crank angle sensor, the output 56A of the water temperature sensor 56, and the electrical signal from the heater 24 are inputted into a control circuit 64 constituted by a microcomputer or the like so that the injector 12 and the ignition coil 58 are driven by the output of this control circuit 64.

In the engine system controlled by the arrangement as described above, a bypass 26 bypassing the throttle valve 16 to communicate with the suction pipe 6 is provided and a bypass valve 62 is provided in the bypass 26. A control signal is inputted to a drive section of the bypass valve 62 from the control circuit 64 to control the opening of the bypass valve 62.

That is, the opening of the bypass valve 62 is controlled by a pulse current such that the cross-sectional area of the bypass 26 is changed by the amount of lift of a valve which is in turn controlled by a drive system driven by the output of the control circuit 64. That is, the control circuit 64 produces an open/close period signal for controlling the drive system so that the drive system responds to this open/close period signal to apply a control signal for controlling the amount of lift of the bypass valve 62 to the drive section of the bypass valve 62.

Figure 3:
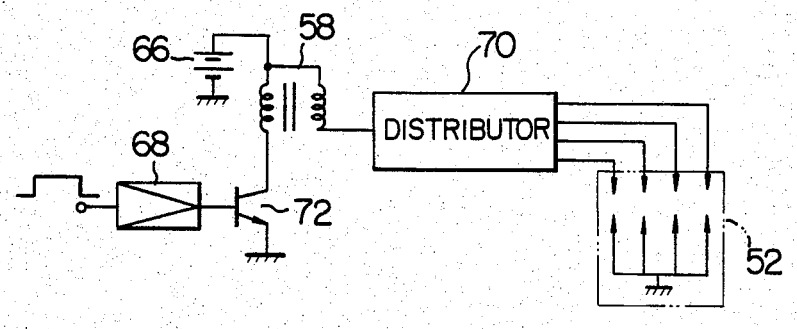
FIG. 3 is a diagram for explaining the ignition device in FIG. 2.

In FIG. 3, which is an explanatory diagram of the ignition device of FIG. 2, a pulse current is supplied to a power transistor 72 through an amplifier 68 to energize this transistor 72 so that a primary coil pulse current flows into an ignition coil 58 from a battery 66. At the trailing edge of this pulse current, the transistor 74 is turned off so as to generate a high voltage at the secondary coil of the ignition coil 58.

This high voltage is distributed through a distributor 70 to ignition plugs 52 provided at the respective cylinders in the engine, in synchronism with the rotation of the engine.

Figure 4:
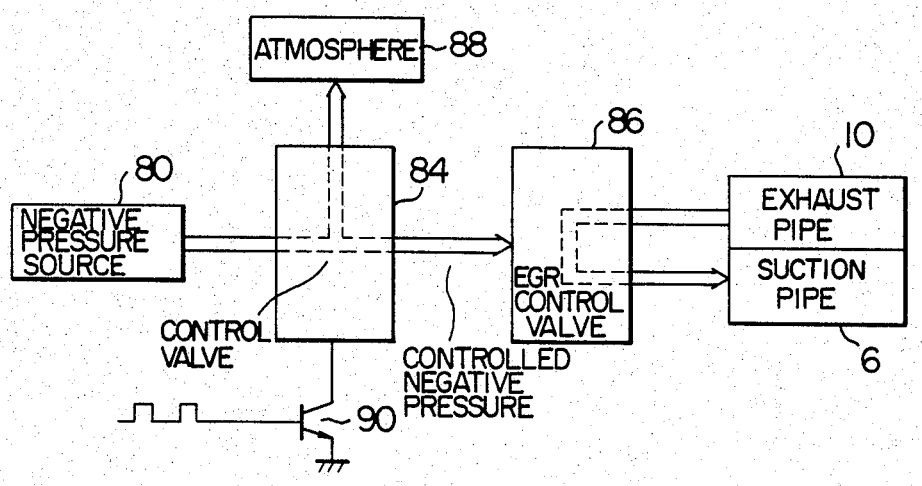
FIG. 4 is a diagram for explaining the exhaust gas recirculation system.

In FIG. 4, which is an explanatory diagram of an exhaust gas reflux (hereinafter abbreviated as EGR) system, a predetermined negative pressure of a negative pressure source 80 is applied to an EGR control valve 86 through a pressure control valve 84. The pressure control valve 84 controls the ratio with which the predetermined negative pressure of the negative pressure source is released to the atomosphere 88, in response to the ON duty factor of the repetitive pulse applied to a transistor 90, so as to control the state of application of the negative pressure pulse to the EGR control valve 86. Accordingly, the negative pressure applied to the EGR control valve 86 is determined by the ON duty factor of the transistor 90 per se. The amount of EGR from the exhaust pipe 10 to the suction pipe 6 is controlled by the controlled negative pressure of the pressure control valve 84.

FIG. 5 is a diagram showing the whole configuration of the control system which is constituted by a central processing unit (hereinafter abbreviated as CPU) 102, a read only memory (hereinafter abbreviated as a ROM) 104, a random access memory (hereinafter abbreviated as RAM) 106, and an input/output (hereinafter abbreviated as I/O) circuit 108. The CPU 102 operates on input data from the I/O circuit 108 in accordance with various programs stored in the ROM 104 and returns the result of operation to the I/O circuit 108. Temporary data storage necessary for such an operation is performed by using the RAM 106. Exchange of various data among the CPU 102, the ROM 104, the RAM 106, and the I/O circuit 108 is performed through a bus line 110 constituted by a data bus, a control bus, and an address bus.

The I/O circuit 108 includes input means such as the above-mentioned first analog-to-digital converter (hereinafter abbreviated as ADC1), a second analog-to-digital converter (hereinafter abbreviated as ADC2), an angular signal processing circuit 126, and a discrete I/O circuit (hereinafter abbreviated as DIO) for inputting-/outputting one bit information.

In the ADC1, the respective output signals of a battery voltage sensor (hereinafter abbreviated as VBS) 132, the above-mentioned cooling water temperature sensor (hereinafter abbreviated as TWS) 56, an atmosphere temperature sensor (hereinafter abbreviated as TAS) 112, a regulation voltage generator (hereinafter abbreviated as VRS) 114, the above-mentioned throttle opening sensor (hereinafter referred to as $\theta$THS) 116, and a $\lambda$ sensor (hereinafter abbreviated as $\lambda$S) 118 are applied to the above-mentioned multiplexer 120 (hereinafter provided as MPX) 120 which selects one of the respective input signals and applies the selected signal to an analog-to-digital converter circuit (hereinafter abbreviated as ADC) 122. The digital value of the output of the ADC 122 is stored in a register (hereinafter abbreviated as REG) 124.

An output signal of an air flow rate sensor (hereinafter abbreviated as AFS) 24 is inputted to the ADC2 in which the signal is A/D converted in an ADC 128 and set in a REG 130.

An angle sensor (hereinafter abbreviated as ANGS) 146 produces a reference signal representing a reference crank angle (hereinafter abbreviated as REF), for example as a signal generated at an interval of 180 degrees of crank angle, and a position signal representing a small crank angle (hereinafter abbreviated as POS), for example 1 (one) degree. The REF and POS are applied to the angular signal processing circuit 126 to be waveform-shaped therein.

The respective output signals of an idle switch 148 (hereinafter abbreviated as IDLE-SW) 148, a top gear switch (hereinafter abbreviated as TOP-SW) 150, and a starter switch 152 (hereinafter abbreviated as START-SW) are inputted into the DIO.

Next, a circuit for outputting pulses in accordance with the result of operation of the CPU 102 and an object to be controlled will be described hereunder. An injector circuit (hereinafter abbreviated as INJC) 134 is provided for converting the digital value of the result of operation into a pulse output. Accordingly, a pulse having a pulse width corresponding to the amount of fuel injection is generated in the INJC 134 and applied to the injector 12 through an AND gate 136.

An ignition pulse generating circuit (hereinafter abbreviated as IGNC) 138 includes a register (hereinafter referred to as ADV) for setting ignition timing and another register (hereinafter referred to as DWL) for setting initiating timing of the primary current conduction of the ignition coil 58 and these data are set by the CPU 102. The ignition pulse generating circuit 138 produces a pulse on the basis of the thus set data and supplies this pulse through an AND gate 140 to the amplifier 68 described in detail with respect to FIG. 3.

The rate of opening of the bypass valve 62 is controlled by a pulse supplied thereto by a control circuit (hereinafter referred to as ISCC) 142 through an AND gate 144. The ISCC 142 has a register ISCD for setting a pulse width and another register ISCP for setting a repetitive pulse period.

An EGR amount controlling pulse generating circuit (hereinafter abbreviated as EGRC) 180 for controlling the transistor 90 which controls the EGR control valve 86 as shown in FIG. 4, has a register EGRD for setting a value representing the duty factor of the pulse and another register EGRP for setting a value representing the repetitive period of the pulse. The output pulse of the EGRC 154 is applied to the transistor 90 through an AND gate 156.

The one-bit I/O signals are controlled by the circuit DIO. The I/O signals include the respective output signals of the IDLE-SW 148, the TOP-SW 150 and the START-SW 152 as input signals, and include a pulse signal for controlling the fuel pump 32 as an output signal. The DIO includes a register DDR for determining whether a terminal be used as a data inputting one or a data outputting one, and another register DOUT for latching the output data.

A register (hereinafter referred to as MOD) 160 is provided for holding commands instructing various internal states of the I/O circuit 108 and arranged such that, for example, all the AND gates 136, 140, 144, and 156 are turned on/off by setting a command into the NOD 160. The stoppage/start of the respective outputs of the INJC 134, IGNC 138, and ISCC 142 can be thus controlled by setting a command into the MOD 160.

Figure 6:
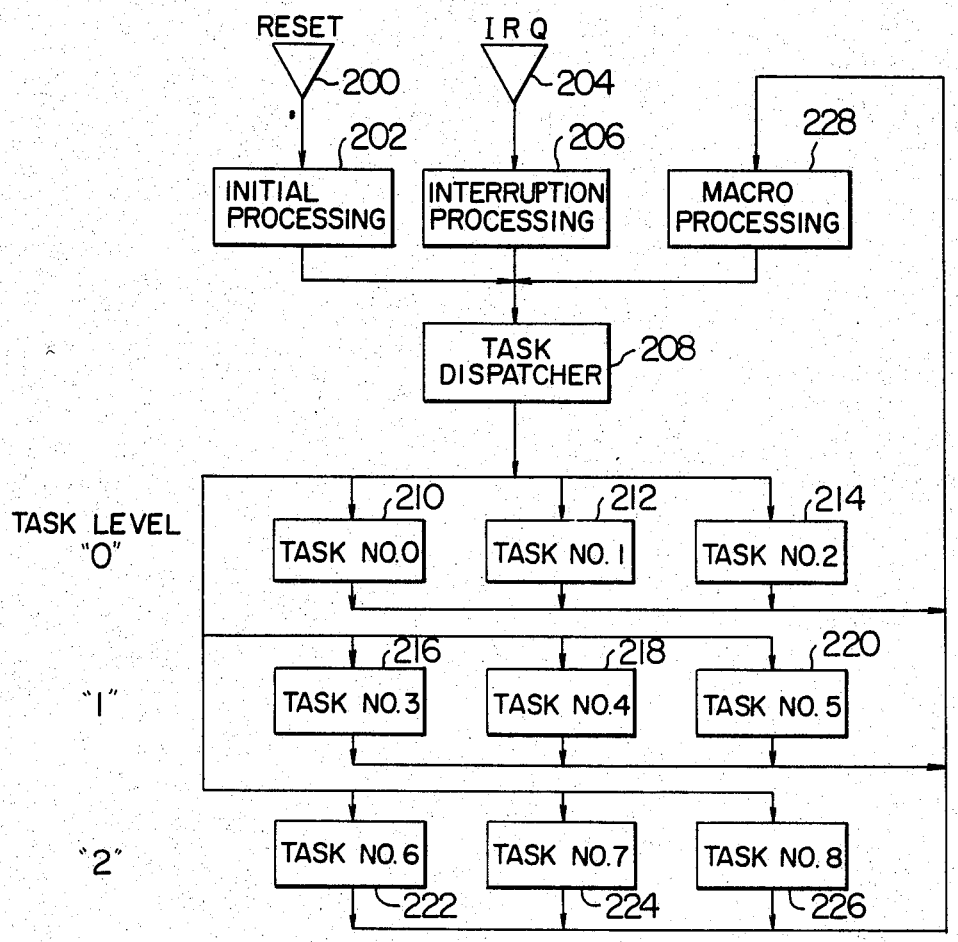
FIG. 6 is a block diagram illustrating the basic construction of the program system for the engine control process according to the present invention.

FIG. 6 is a diagram illustrating a basic configuration of a program system of the control circuit of FIG. 5.

In FIG. 6, an initial processing program 202, an interruption processing program 206, a macro processing program 228, and a task dispatcher 208 are programs for controlling various tasks. The initial processing program 202 is for executing preprocessing for causing a microcomputer to operate. According to the initial processing program 202, for example, the RAM 106 is cleared, the initial values of registers in the I/O interface circuit 108 are set, and processing for taking-in data, such as the cooling water temperature Tw, the battery voltage, for performing the preprocessing necessary for performing the engine control is executed. The interruption processing program 206 receives various interruptions, analyzes the factors of the interruptions, and produces a request for causing a desired one of tasks 210 to 226 to the task dispatcher 208. The interruption factors include an A/D conversion interruption (ADC) generated upon the completion of A/D conversion of the input data such as the power source voltage, the cooling water temperature as described later, an initial interruption (INTL) generated in synchronism with the engine revolution, an interval interruption (INTV) generated at a predetermined interval of time, for example every 10 msec, an engine stoppage interruption (ENST) generated upon the detection of the engine stoppage, or the like.

Task numbers representing priority are allotted to the tasks 210 to 226, and the respective tasks belong to any one of the task levels "0", "1", and "2". That is, the task Nos. 0 to 2 belong to the task level "0", the task Nos. 3 to 5 belong to the task level "1", and the task Nos. 6 to 8 belong to the task level "2".

Upon the reception of the activation requests by the above-mentioned various interruptions, the task dispatcher 208 responds to the activation requests to allot occupation time onto the CPU to the respective tasks in accordance with the priority rank attached to the respective tasks corresponding to the activation requests.

The task priority control by the task dispatcher 208 is performed by the following method:

(1) The task of low priority rank is interrupted and the displacement of the right of execution to the task of higher priority rank is effected between different task levels. It is assumed here that the task belonging to the level "0" has the highest priority rank;

(2) In the case there is a task which is executing or being interrupted at present in the same task level, the task has the highest priority rank and other tasks can not be operated before the task has been completed; and (3) In the case there are activation requests for a plurality of tasks in the same task levels, a task having a smaller task number has a higher priority rank. In order to perform the above-mentioned priority control, according to the present invention, a soft timer is provided in the RAM 106 for each task and control blocks for controlling tasks are set in the RAM for each task level, while the contents of processing of the task dispatcher 208 will be described later. Every time each of the tasks has been executed, the task dispatcher 208 is informed of the completion of execution of the task by the macro processing program 228.

Referring to FIGS. 7 to 13, the contents of processing of the task dispatcher 208 will be described. FIG. 7 shows task blocks of the same number as that of the task levels, that is three in this embodiment since there are three task levels "0" to "2", are provided in the RAM controlled by the dispatcher 208. Eight bits are allotted to each control block. Three of the eight bits, that is 0-th to 2nd bits ($Q_0$–$Q_2$), are the activation bits for performing activation request task indication and the 7-th bit (R) is used for execution bit for indicating whether any one of the same task level is being executed or being interrupted. The activation bits $Q_0$–$Q_2$ are arranged in the order of decreasing the priority rank. For example, the activation bit corresponding to the task No. 4 in FIG. 6 is $Q_0$ in the task level "1". When a task activation request is issued, a flag "1" is set to any one of the activation bits, and at the same time the task dispatcher 208 searches for the issued activation request in the activation bits in the order from the activation bit corrresponding to the task of higher level so that the flag corresponding to the issued activation request is reset and flag "1" is set to the execution bit to thereby execute the processing for activating the task corresponding thereto.

FIG. 8 shows an activation address table provided in the RAM 106 controlled by the task dispatcher 208. SA0 to SA8 represent the activation addresses correspond to the task Nos. 0 to 8 of the tasks 210 to 226 as shown in FIG. 6. Sixteen bits are allotted to each activation address information which is used for the task dispatcher 208, as described later, to activate the task corresponding to the issued activation request.

Figure 9:
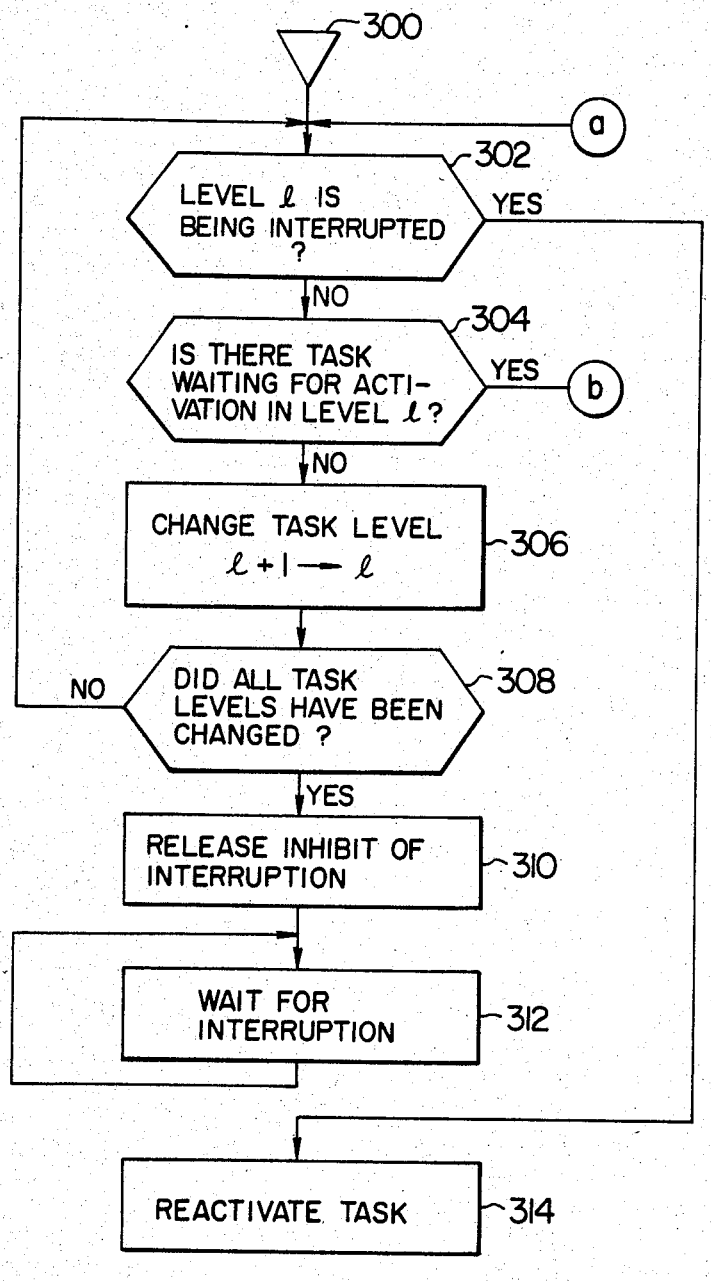
FIGS. 9 and 10 are flowcharts for the processes of the task dispatcher.
Figure 10:
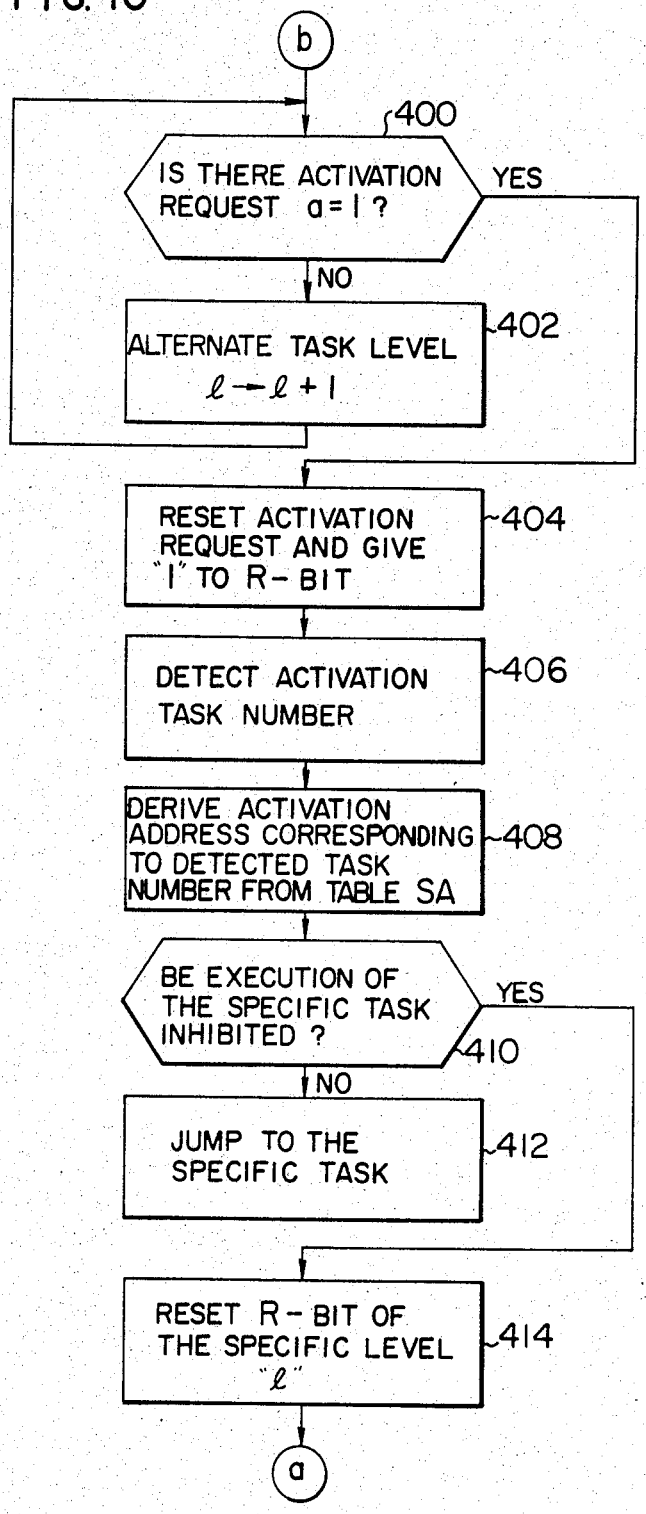

FIGS. 9 and 100 show flowcharts for the processing performed by the task dispatcher 208. Upon the initiation of the processing by the task dispatcher 208 in a step 300 in FIG. 9, judgement is made as to whether the tasks belonging to the task level l are being executed or interrupted in a step 302. That is, if flag "1" is detected in the execution bit, the flag "1" indicates the state that the macro processing program 228 does not yet issue the task completion information to the task dispatcher 208 and the task which had been executed is being interrupted because interruption of higher priority rank has been generated. Accordingly, if flag "1" is detected in the execution bit, the processing is jumped to a step 314 in which the interrupted task is reactivated.

In the case no flag "1" is detected in the execution bit, on the contrary, that is when the execution indication flag is reset, the processing is shifted to the step 304 in which judgement is made as to whether there is any task waiting for activation in the level l. That is, the activation bits in the level l are searched for in the order of decreasing the priority rank of the tasks corresponding to the activation bits, that is in the order of $Q_0$, $Q_1$ and $Q_2$. If no flag "1" is detected in any one of the activation bits belonging to the level l, the processing comes to a step 306 in which the task level is altered. That is, the task level l is incremented by +1 so as to be l+1. Upon the alteration of the task level in the step 306, the processing comes to a step 308 in which judgement is made as to whether all the task levels have been checked. In the case where all the task levels have been not yet checked, that is, when $l \neq 2$ in this embodiment, the processing comes back to the step 302 and the above-mentioned processing is repeated. In the case where the result of judgement proves that all the task levels have been checked in the step 308, the processing comes to a step 310 in which inhibit to interruption is released because interruption has been inhibited during the processing in the steps 302 to 308. Thereafter, in the next step 312, next issued interruption is waited for.

If there is a task waiting for activation in the level l in the step 304, that is if flag "1" is detected in one of the activation bits belonging to the task level l, the processing comes to a step 400. In the loop constituted by the step 400 and the next step 402, search is made as to which one of the activation bits in which one of the task levels is provided with flag "1", in the order of decreasing the priority rank of the task levels, that is in the order of $Q_0$, $Q_1$, and $Q_2$. When the activation bit provided with flag "1" is detected, the processing comes to a step 404 in which the activation bit provided with flag "1" is reset and flag "1" is set to the execution bit (hereinafter referred to R) of the same task level. In a step 406, the number of the activated task is detected, and in a step 408, the activation address information as to the activated task is derived in accordance with the activation address table provided in the RAM as shown in FIG. 8.

In a step 410, judgement is made as to whether the activated task be executed or not. In this case, the necessity of the execution is judged on the basis of the value of the activation address information. That is, when the activation address information has a specific value, for example "0", the judgement is such that the execution is not necessary. It is necessary to provide this judgement step in order to cause a car to have a function of performing only a specific one of the task functions for performing engine control selected depending on the kind of the car. When judgement is made in the step 410 such that the execution of the specific task is stopped, the processing comes to a step 414 in which the R-bit of the specific task level l is reset. Then, the processing comes back to the step 302 in which judgement is made as to whether the task level l is being interrupted or not. This is because there may be a case where a plurality of activation bits are provided with flag "1".

In the case where the execution of the specific task in not inhibited, that is when the specific task be executed, the processing comes to a step 412 in which jump is made to the specific task so as to execute the task.

Figure 11:
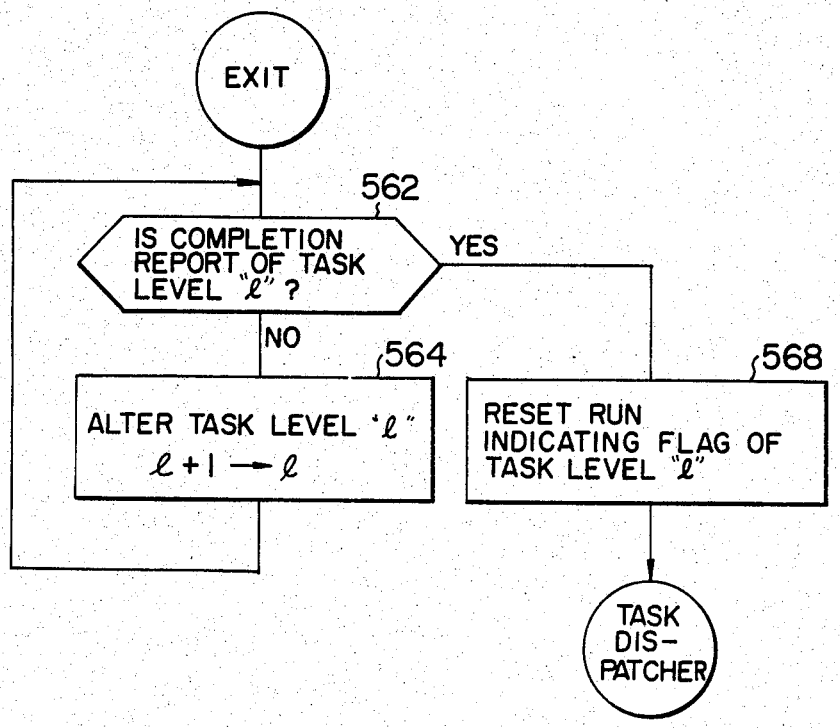
FIG. 11 is a flowchart for executing a macro processing program.

FIG. 11 shows a flowchart for processing the macro processing program 228. This program is constituted by steps 562 and 564. In these steps 562 and 564, the task levels are searched in the order of increasing the task level, that is in the order from the level "0" so as to find completed task level or levels. Then the processing comes to a step 568 in which the execution (RUN) flag provided in the 7th bit in the task control block of the completed task is reset. Thus, the execution of the task has been completed. Then, the processing comes back to the task dispatcher 208 in which the next execution task is determined.

Figure 12:
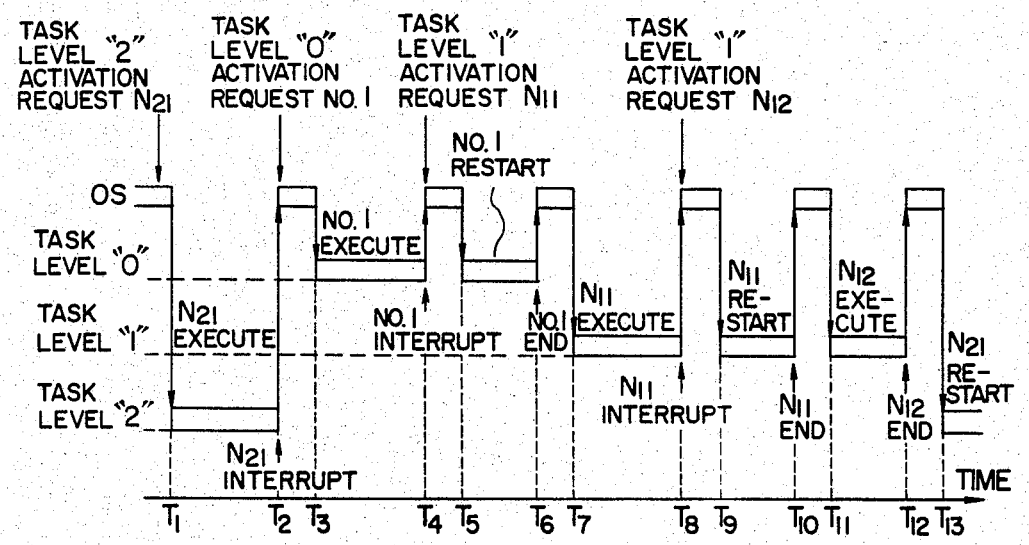
FIG. 12 is a diagram showing an example of task priority control.

Referring to FIG. 12, the execution and interruption of a task will be explained for the case where the task priority control is performed by the task dispatcher 208. Assume that in the activation request $N_{mn}$, m represents the task level and n represents the rank of priority in the task level m, and that the CPU is executing the control program OS. Then, when an activation request $N_{21}$ is generated in executing this control program OS, the execution of the task corresponding to the activation request $N_{21}$, that is the execution of the task No. 6, is initiated at the time $T_1$. If another activation request $N_{01}$ for the task having a higher execution priority rank is issued at the time $T_2$ in executing the task No. 6, the execution is shifted to the control program OS and after a predetermined processing has been performed as already described, the execution of the task corresponding to the activation request $N_{01}$, that is the execution of the task No. 0, is initiated at the time $T_3$. When a further activation request $N_{11}$ is issued at the Time $T_4$ in executing the task No. 0, the execution is once shifted to the control program OS and after a predeterined processing has been executed, the execution of the task No. 0 which has been so far interrupted is restarted at the time $T_5$. When the execution of the task No. 0 is completed at the time $T_6$, the execution is shifted again to the control program OS, the completion of execution of the task No. 0 is reported by the macro processing program 228 to the task dispatcher 208, and then the execution of the task No. 3 which corresponds to the activation request $N_{11}$ and which has been so far waiting for reactivation is initiated at the time $T_7$. When an activation request $N_{12}$ having a lower priority rank in the same task level "1" is issued at the time $T_8$ *in executing the task No.* 3, the execution of the task No. 3 is once interrupted, the execution is once shifted to the control program OS, and after a predetermined processing has been performed, the execution of the task No. 3 is restarted at the time $T_9$. Upon the completion of the execution of the task No. 3 at the time $T_{10}$, the execution of the CPU is shifted to the control program OS, the completion of execution of the task No. 3 is reported by the macro program 228 to the task dispatcher 208, the execution of the task No. 4 corresponding to the activation request $N_{12}$ of lower priority rank is initiated at the time $T_{11}$, the execution is shifted to the control program OS upon the completion of execution of the task No. 4 at the time $T_{12}$, and after a predetermined processing has been performed the execution of the task No. 6 which corresponds to the activation request $N_{21}$ and which has been so far interrupted is restarted at the time $T_{13}$.

The task priority control is performed in the manner as described above.

Figure 13:
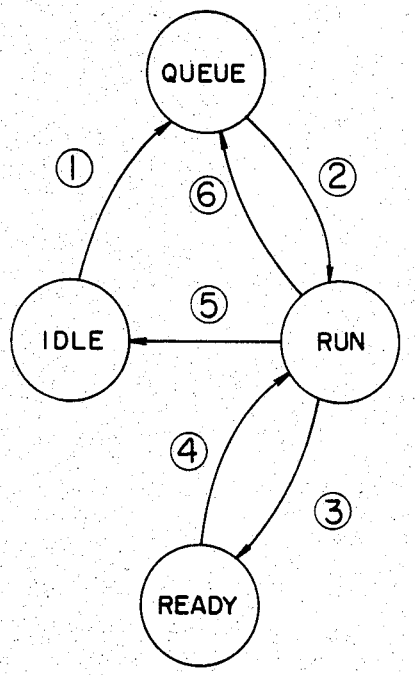
FIG. 13 is a diagram showing the transition of the state of the task in the above-mentioned task priority control.

The state of transition in the task priority control is illustrated in FIG. 13 "Idle" represents the state in which activation is waited for and no task activation request has been issued. Then, if an activation request is issued, flag "1" is set to the activation bit of the task control block so as to indicate the necessity for activation. The time required for shifting from the state "Idle" to the state "Queue" is determined by the level of the respective task. In the state "Queue", the order of execution is determined on the basis of the rank of priority. The specific task is brought into the state of execution after the flag of the activation bit of the task control block has been reset by the task dispatcher 208 in accordance with the control program OS and a flag "1" has been set to the R-bit (7th bit). Thus the execution of task is initiated. This is the state "Run". Upon the completion of execution, the flag of the R-bit of the task control block is cleared and the completion report is terminated. Thus, the state "Run" ends and the state "idle" is recovered to wait for the issuance of the next activation request. If an interruption request IRQ is generated in executing a task, that is in the state "Run", the execution of the task has to be interrupted. For this, the contents of the CPU is shunted and the execution is interrupted. This state is "Ready". Next, when the state in which the task is to be executed is recovered, the shunted contents are returned back to the CPU and execution is restarted. That is, the state "Run" is recovered from the state "Ready". Thus, the respective level program repeats the four states of FIG. 13. FIG. 13 shows a typical flow. However, there may be a case where a flag "1" is set to the activation bit of the task control block in the state "Ready". This is the case, for example, in the state of interruption of activation of a task, the next actuation request timing of the task is reached. In this case the flag in the R-bit takes preference and the task which is being interrupted is terminated. Thus, the flag in the R-bit is cleared and the state becomes "Quene" bypassing the state "Idle" due to the flag in the activation bit. Thus, each of the tasks Nos. 0 to 7 is in any one of the four states of FIG. 13.

Figure 14:
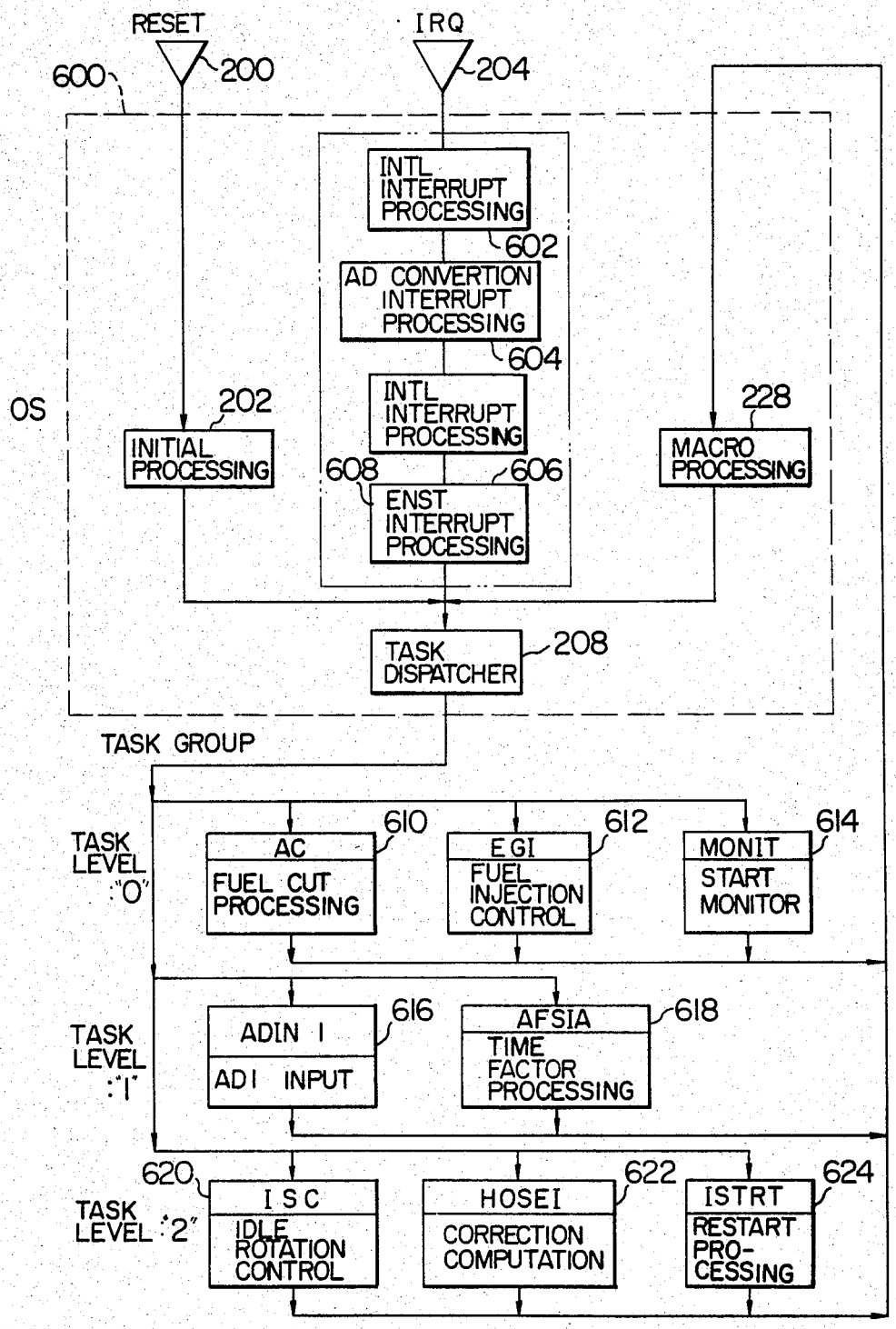
FIG. 14 is a particular flowchart in FIG. 6.

FIG. 14 shows a particular embodiment of the program system as shown in FIG. 6. In FIG. 14, a control program OS includes an initial processing program 202, an interruption processing program 206, a task dispatcher 208, and a macro processing program 228.

The interruption program 206 includes various kinds of interruption processing programs in which an initial interruption processing (hereinafter referred to as an INTL interruption processing) 602 generates initial interruptions in the number of half the number of the engine cylinders per revolution, for example twice per revolution in the case of four cylinders, due to an initial interruption signal generated in synchronism with the engine revolution. The data indicative of the fuel injection timing computed by an EGI task 612 in response to the above-mentioned INTL interruption is set in a register INJD in the INJC 134 included in the I/O interface circuit 108 (FIG. 5). An A/D conversion interruption processing 604 includes two kinds of interruption, that is, an ADC1 (FIG. 5) interruption and an ADC2 (FIG. 5) interruption. The ADC1 (FIG. 5) has the accuracy of 8 bits, and is used for inputting data such as the battery voltage, the cooling water temperature, the suction air temperature, the regulated voltage, etc., applied thereto. The ADC1 starts the A/D conversion as soon as the input point to the MPX 120 (FIG. 5) is assigned, and issues the ADC1 interruption upon the completion of the A/D conversion. The ADC1 interruption is used only before cranking. The ADC 128 in the ADC2 (FIG. 5) is used for inputting the data indicative of the air flow rate and generates the ADC2 interruption immediately after the A/D conversion. The ADC2 interruption is also used only before cranking.

In an interval (hereinafter abbreviated as INTV) interruption processing program 606, an INTV interruption signal is generated at a time interval of a predetermined time of, for example, 10 msec set in an INTV register (not shown) and is used as a basic signal for monitoring the activating timing of tasks to be activated at a predetermined interval of time. This INTV interruption signal updates the soft timer thereby activating the mask now ready to be activated. In an engine stoppage task (hereinafter referred to as an ENST task) interruption processing program 608 is for detecting state of ENST and starts counting in response to the detection of an INTL interruption signal so as to issue an ENST interruption when no INTL interruption signal can be detected within a predetermined period of time of, for example, 1 sec. When the ENST interruption is issued three times, that is, when no INTL interruption can be detected within a period of time of, for example, 3 sec, the engine is judged as having stopped, and energization of the ignition coil 58 and operation of the fuel pump 32 are ceased. After execution of these processing steps, the microcomputer stands by until the START-SW 152 is turned on. Table 1 shows the outline of processing executed in response to the interruption signals described above.

TABLE 1

| Interrupt | Outline of processing |
|---|---|
| INTL | Ignition timing is set in INJD in INJC 134. |
| ADC1 | Task ADIN1 is activated. |
| ADC2 | Air flow-rate signal processing task AC is activated. |
| INTV | Activating timings of tasks ADIN2, EGI, MONIT, ADIN1, AFSIA and ISC to be activated at predetermined periods are checked to activate the task now ready to be activated. |
| ENST | ENST interrupt processing is executed to initialize the system. |

As to the INTL processing program 202 and the macro processing program 228, the processing steps are performed in the manner as described above.

The following tasks are activated in response to the various interruptions as described above. Tasks belonging to the task level "0" include a fuel cutting processing task (hereinafter referred to as an AC task), a fuel injection control task (hereinafter referred to as an EGI task), and a starting timing monitoring task (hereinafter referred to as an MONIT task). Tasks belonging to the task level "1" include an AD1 input task (hereinafter referred to as an ADIN1 task) and a time coefficient processing task (hereinafter referred to as an AFCIA task). Tasks belonging to the task level "2" include an idling rotation control task (hereinafter referred to as an ISC task), a compensation computation task (hereinafter referred to as an HOSEI task), and a pre-starting processing task (hereinafter referred to as an ISTRT task).

Table 2 shows the allocation of the task levels and the functions of the individual tasks.

TABLE 2

| Level | Program | Task No. | Function | Activation period |
|---|---|---|---|---|
| 0 | OS | INTL | Engine-rotation-interruption control | AT LEAST 5 msec |
| 1 | | | Other OS processing | |
| 0 | AC | 0 | Fuel Cutting | 10 msec |
| | EGI | 1 | Adjustment of integration flow-rate reference level | 20 msec |
| | MONIT | 3 | Monitoring of START-SW (OFF), control of fuel injection time in starting stage, start-stop of soft timers | 40 msec |
| 1 | ADIN1 | 4 | Correction and filtering of inputs to ADC 122 | 50 msec |
| | AFSIA | 6 | Control of after-starting, after-idling and after-acceleration time factors | 120 msec |
| 2 | ISC | 8 | Idling rotation speed control | 160 msec |
| | HOSEI | 9 | Compensation factor computation | 300 msec |
| | ISTRT | 11 | Computation of EGI initial value, monitoring of START-SW (ON), start-stop of soft timers, starting of fuel pump, starting of I/O LSI | 30 msec |

As will be apparent from Table 2, the activation periods of the individual tasks activated in response to the various interruptions are previously determined, and this information is stored in the ROM 104.

Figure 15:
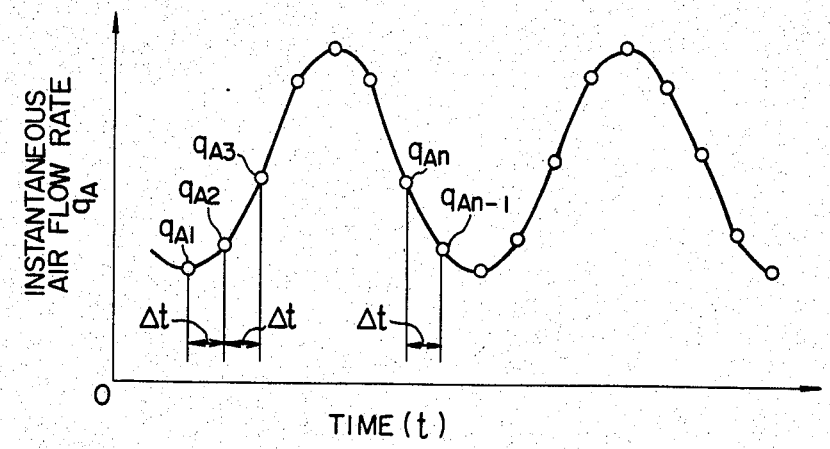
FIG. 15 is a diagram showing the timing for taking-in the hot-wire output voltage.
Figure 16:
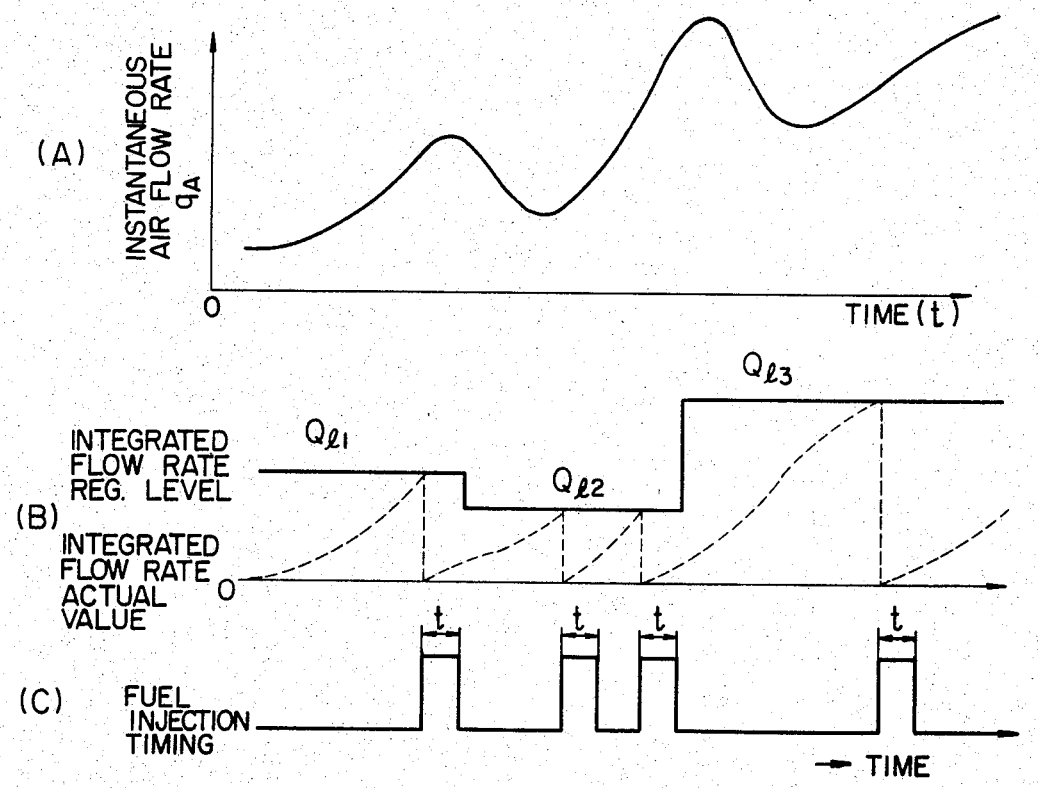

Discription will now be directed as to the processing of the output signal from the hot-wire type flow rate sensor and the fuel injection control. FIG. 16 shows the manner of processing of the output signal from the hot-wire type flow rate sensor employed in the present invention. The instantaneous air flow rate $q_A$ can be computed from the hot-wire sensor output voltage v from the equation (5). Since the instantaneous air flow rate $q_A$ is an instantaneous value in the pulsating state as shown in FIG. 15, it is sampled at a predetermined time interval $\Delta t$. The mean air flow rate $Q_A$ can be computed from the respective sampled values of the instantaneous air flow rate $q_A$ according to the following equation:

$$Q_A = \frac{q_{A1} \cdot \Delta t + q_{A2} \cdot \Delta t + \ldots + q_{An} \cdot \Delta t}{n \cdot \Delta t} = \frac{\sum_{n=1}^{n} q_{An}}{n} \quad (8)$$

Thus, the air flow rate sucked into the cylinder can be obtained as $$\sum_{n=1}^{n} q_{An}$$

from the equation (8). Thus, the integrated air flow rate can be obtained by the above-mentioned signal processing.

The control of fuel injection will be next described. According to the present invention, the fuel injection may be performed in such a manner that the amount of fuel injected per revolution of the engine is computed on the basis of the equation (7), to thereby perform fuel injection once per one suction stroke in each cylinder, for example, once every 180° rotation of the crank in the case of engine provided with 4 cylinders. Alternatively, the fuel injection may be performed when the integrated air flow rate actual value attains a given level. Although an embodiment in which the present invention is applied to the latter fuel injection system, the present invention can be applied to the former one.

FIG. 16 shows the timing of fuel injection according to the above-mentioned latter fuel injection system. The instantaneous air flow rate $q_A$ is integrated for a predetermined period of time, and, when the integrated air flow rate actual value attains or exceeds an integrated air flow rate reference level $Q_l$, fuel is injected for a predetermined period of time t as seen in FIG. 16. That is, fuel is injected at the timing at which the integrated instantaneous air flow rate actual value has attained the integrated air flow rate reference level $Q_l$. In FIG. 16, there are shown three integrated air flow rate reference levels $Q_{l1}$, $Q_{l2}$ and $Q_{l3}$. When the integrated air flow rate reference level is shifted from $Q_{l1}$ to $Q_{l2}$, the fuel-air mixture becomes richer, while when it is shifted from $Q_2$ to $Q_3$, the fuel-air mixture becomes leaner. According to this system, the integrated air flow rate reference value $Q_I$ is suitably shifted so as to adjust the air-fuel ratio (A/F) as described. A rich fuel-air mixture is required during warming-up in the engine starting stage, and this can be achieved by reducing the integrated air flow rate reference level $Q_I$. For the optimized control of the air-fuel ratio, the integrated air flow rate reference level $Q_I$ can be suitably adjusted by the ON-OFF of the output from an $O_2$ sensor (not shown).

FIG. 17 is a flowchart for processing the taking-in of the output signal of the hot-wire type flow rate sensor and the timing of the fuel injection.

Referring to FIG. 17, judgement is made in a step 801 as to whether the interruption is an INTL interruption or not. When the result of judgement in the step 801 proves that the interruption is an INTL one, the ADV REG in IGNC 138 is set so as to complete the INTL interruption processing program. When the result of judgement in the step 801 proves, on the contrary, that the interruption is not the INTL one, judgement is made in a step 805 as to whether the interruption is the $Q_A$ timer interruption or not. When the result of judgement in the step 801 proves that the interruption is a $Q_A$ timer interruption, activation is made for taking-in the output of the hot-wire type flow rate sensor in a step 806, and taking-in of the output of the hot-wire type flow rate sensor is performed in a step 807. The instantaneous air flow rate $q_A$ as shown in the equation (5) is computed in a step 808 and the integration processing is performed in a step 809. Judgement is made in a step 810 as to whether the integrated value of the instantaneous air flow rate has reached the integrated air flow rate reference level. When the result of judgement in the step 810 proves that the integrated air flow rate reference level has been reached, a period of time of fuel injection t corresponding to the integrated air flow rate reference level is set in a step 811 into the INJD REG of INJC 134 (FIG. 5), and basic injection pulse is produced in a step 812 from the INJD REG of INJC 134 to the injector 12 through the AND gate 136 to initiate the injection with the basic fuel amount $T_P$. At this time, the width of the basic injection pulse is determined by the period of time t for injection, and the amount of basic fuel injection $T_P$ is determined by the integrated air flow rate reference level. In a step 813, the difference between the integrated air flow rate actual value and the integrated air flow rate reference level is computed to regard it as the present integrated air flow rate. When the result of judgement in the step 805 proves that the interruption is not a $Q_A$ timer interruption, judgement is made in a step 815 as to whether the interruption is an ADC interruption or not. When the result of judgement in the step 815 proves that it is an ADC one, judgement is made in a step 816 as to whether or not the IST flag is in the state "1". When the result of judgement in the step 816 is "YES", the hot-wire type flow rate sensor is activated and the output of the same is taken-in in a step 817. The thus taken-in value of the air flow rate is used for detection of the engine start due to rotation torque of wheels. When the result of judgement in the step 815 proves that the interruption is not an ADC one, as well as when the result of judgement in the step 816 is "NO", the processing is shifted to the INTV interruption processing 606 in FIG. 14.

FIG. 18 shows the relation between the temperature TW of engine cooling water sensed by the cooling water temperature sensor 56 and the air flow rate reference level. That is, FIG. 18 shows how the reference level is varied relative to the output signal of the water temperature sensor 56. The temperature range of from −40° C. to 40° C. corresponds to the warming-up level in which the engine is started from its cold state. The temperature range from 40° C. to 85° C. corresponds to the normal starting level, and the temperature range higher than 85° C. corresponds to the hot re-starting level. As soon as the engine key is turned on to start the engine, the sensor output signal indicative of the temperature of the engine cooling water is taken into the ADC1 so that the air amount reference level corresponding to the sensed temperature can be set by comparison according to the relation shown in FIG. 18. The INTST program 624 shown in FIG. 15 is executed for this purpose.

The fuel control processing in acceleration using the fuel control apparatus according to the present invention will be explained referring to FIGS. 19 to 25.

In case of accelerating a car, as shown in FIG. 19(A), the throttle opening change rate is relatively large near the start of acceleration (period $t_1-t_2$) because the throttle valve is opened abruptly but it becomes smaller near the end of acceleration (period $t_2-t_3$).

The basic fuel injection amount $T_P$ is injected in response to a basic fuel injection pulse when the integrated flow rate actual value reaches the reference value. As shown in FIG. 19(B), if the suction air flow rate increases with the increase of the throttle opening detected by the throttle sensor 116 in FIG. 5 in a period $t_1-t_2$, the period of the basic fuel injection pulse a becomes shorter, so that the basic fuel injection amount increases almost in proportion to the suction air flow rate. Now, the basic fuel injection pulse a shows a pulse injected at a step 812 of FIG. 17. In the present invention, the acceleration state is detected on the basis of the throttle opening change rate, a compensation factor for K acceleration is calculated on the basis of the throttle opening change rate, and the additional fuel injection amount To for acceleration is obtained by multiplying the amount To by the factor K. Thus, the additional fuel injection amount To is large near the start of acceleration because the throttle valve change rate is large, but the amount To becomes smaller near the end of acceleration because the throttle opening change rate is small as shown in FIG. 19(B).

Namely, the pulse width of each of an interruption fuel injection pulse c, delivered every 10 m sec and an additional fuel injection pulse b added to the basic fuel injection pulse a becomes longer in a period $t_1-t_2$, but becomes shorter gradually in a period $t_2-t_3$. (The additional fuel injection amount is injected in response to the injection pulses b and c.) However, during acceleration the suction air flow rate does not increase promptly in proportion to the increase of the throttle opening due to the inertia of the suction air. Thus, the change rate of the suction air is small near the start of acceleration as shown in FIG. 19(C) even though the throttle opening change rate is large, but the change rate of suction air becomes large near the end of acceleration even though the throttle opening change rate is small, so that the fuel-air mixture becomes lean near the end of acceleration to thereby cause the shortage of acceleration.

To obviate this drawback, the first embodiment of the present invention calculates the throttle opening change rate successively with a pregiven period and always calculates the additional fuel injection amount on the basis of maximum value of throttle opening change rate during acceleration.

FIG. 20 is a flowchart illustrating a method of obtaining an additional fuel injection amount during acceleration. This flowchart is executed every pregiven period, in this case 10 m sec. At first, in step 901, a throttle opening (degree) TH is fetched from the throttle sensor 116 and converted into a digital signal and then stored in the RAM. Next, in step 902, a difference ΔTH between the presently fetched throttle opening TH and a throttle opening TH(OLD) which has been fetched 30 m sec earlier is obtained as the throttle opening change rate. Namely, the throttle opening change rate ΔTH is obtained by subtracting the value TH(OLD) from the value TH. In step 903, judgement is made whether the throttle opening change rate ΔTH is larger than 0or not. If it is proved to be $\Delta TH > 0$, namely that the engine is in an acceleration state, the process proceeds to step 904. In step 904, the presently obtained throttle opening change rate ΔTH is compared with the previously obtained throttle opening change rate ΔTH(OLD) which has been obtained 10 m sec earlier and judgement is made whether the presently obtained throttle opening change rate ΔTH is larger than the previously obtained change rate ΔTH(OLD). Now, the change rate ΔTH(OLD) is obtained by subtracting the throttle opening TH which has been fetched 40 m sec earlier from the throttle opening TH which has been fetched 10 m sec earlier. In step 904, if the judgement proves to be $\Delta TH > \Delta TH(OLD)$, the presently obtained change rate ΔTH is stored in the RAM in place of the previously obtained change rate ΔTH(OLD). Next, in step 905, the compensation factor K is calculated on the basis of the change rate ΔTH and the additional fuel injection amount To is calculated on the basis of the factor K. Then, in step 907, the calculated additional fuel injection amount To is set in the register 134 and then the additional fuel is injected.

If the judgement proves to the $\Delta TH < \Delta TH(OLD)$ in step 904, the process proceeds to step 906. In step 906, the compensation factor K is calculated on the basis of the previously obtained change rate ΔTH(OLD) and the additional fuel injection amount To is calculated on the basis of the calculated factor K. Then, in step 907, the calculated additional fuel injection amount is injected.

Figure 21:
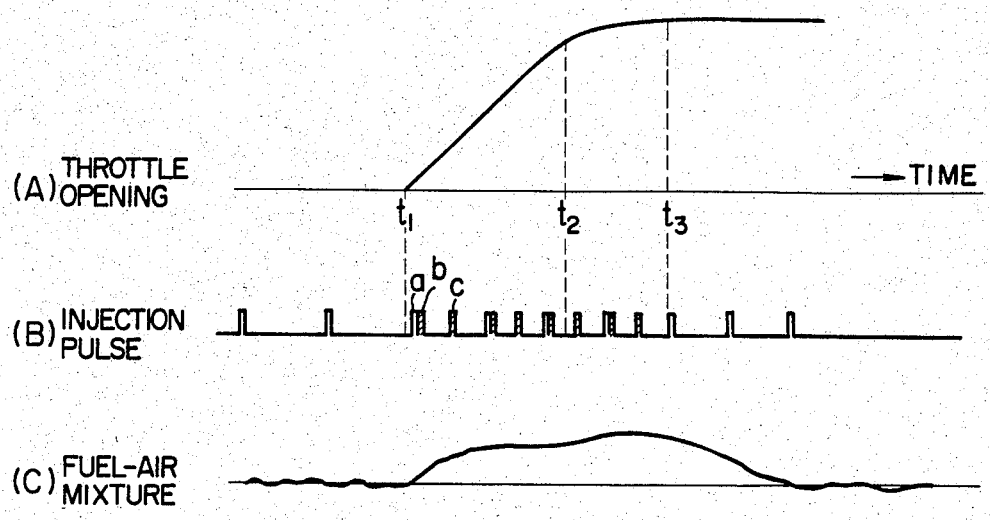

Thus, as shown in a time chart of FIG. 21, when the judgement proves to be $\Delta TH > 0$ at time $t_1$, an interruption fuel injection pulse c and an additional fuel injection pulse b are delivered to the fuel injector in addition to the basic fuel injection pulse a. Hereinafter, as long as the judgement proves to be $\Delta TH > 0$, the additional fuel injection amount To is calculated on the basis of the maximum value among the throttle opening change rates which have been obtained after the detection of acceleration, and then the pulses b and c having pulse width determined by the calculated amount To are delivered. When the judgement proves to be $\Delta TH < 0$ at time $t_3$, the additional fuel injection is stopped and only the basic fuel injection pulse a is delivered.

Thus, this embodiment determines the additional fuel injection amount on the basis of a maximum value among the throttle opening change rates which have been obtained after detection of acceleration, so that the additional fuel injection amount near the end of acceleration is prevented from being decreased to thereby prevent the fuel-air mixture from being lean and accelerate the engine smoothly.

Now, in any embodiments of the present invention, the additional fuel injection may be performed in response to either of the additional fuel injection pulse b and the interruption fuel injection pulse c.

The additional fuel injection is performed in response to the detection of acceleration. The acceleration state is detected in accordance with a throttle opening which is detected by the throttle sensor 116. However, the output signal of the throttle sensor is likely to be superimposed by noises such as ignition noise. If the noise is fetched in the input/output circuit 108 together with the output signal of the throttle sensor, an erroneous throttle opening may be detected and therefore an engine state not in acceleration may be erroneously detected as an acceleration state.

In view of the fact that almost all noises generated in the harness of a car are ignition noises or ones generated upon turning-off of solenoids which appear instantaneously but do not appear for a long time, the judgement to be actual acceleration is made only when the throttle opening change rates ΔTH are detected to be positive for two times successively to thereby prevent erroneous detection of acceleration.

Such a process for preventing erroneous detection of acceleration will be explained referring to a flowchart of FIG. 22. This flow chart is preferably inserted between steps 903 and 904 of FIG. 20. Namely, the presently obtained throttle opening change rate ΔTH is stored in the RAM in step 902 of FIG. 20, and then the judgement is made whether ΔTH is positive or not in step 903. If the judgement proves to be $\Delta TH > 0$, the judgement is made whether the previously obtained throttle opening change rate ΔTH(OLD) stored in the RAM is positive or not in step 910 of FIG. 22. If the judgement proves to be $\Delta TH(OLD) < 0$, it is determined that the engine is in an actual acceleration state and then the additional fuel injection is performed in step 904 on the basis of the presently obtained throttle opening change rate. If the judgement proves to be $\Delta TH(OLD) \leqq 0$, it is determined that an erroneous acceleration state was detected and no additional fuel injection is performed.

Now, the change rate of the suction air flow rate varies depending on the throttle opening (degree). Namely, as shown in FIG. 23, the change rate of the suction air flow rate in case of changing the throttle opening by a pregiven value ΔTH from a small opening position or an idle operation position is larger than the change rate in case of changing the throttle opening by the pregiven value ΔTH from a partially opened position. This is because the change rate of an area of the opening of the throttle valve in case of changing the throttle opening degree by a pregiven value decreases with an increase of the throttle opening degree. Thus, if the additional fuel injection amount To is determined only on the basis of the throttle opening change rate ΔTH, in the acceleration from the idle operation position or the small opening position of the throttle valve, the fuel air mixture is likely to be lean near the start of acceleration to thereby cause the shortage of acceleration because the change rate of the suction air flow rate is relatively larger than the throttle opening change rate near the start of acceleration when the acceleration is started from a small throttle opening position.

Thus, it is desired to prevent the fuel air mixture from being lean near the start of acceleration in case of starting the acceleration from a small throttle opening position.

To attain such an object, it is proposed to divide the throttle opening into a plurality of ranges, and to modify the compensation factor K in accordance with the range to which an initial throttle opening (i.e., a throttle opening at the start of acceleration) belongs in order to prevent the fuel air mixture from being lean near the start of acceleration when the acceleration is started from the small throttle opening position.

Thus, in the embodiment described referring to a flowchart of FIG. 24, the initial throttle opening THo is divided into two ranges with respect to a pregiven threshold level, and the compensation factor K obtained on the basis of the throttle opening change rate is modified in accordance with the range to which the initial throttle opening THo belongs. Namely, when the initial throttle opening THo is smaller than the pregiven threshold level $\alpha$, the compensation factor K obtained on the basis of the thottle opening change rate is increased so as to increase the additional fuel injection amount $T_0$ to thereby prevent the fuel air mixture from being lean near the start of acceleration.

The flowchart of FIG. 24 is executed every 10 msec.

At first, in step 950, the previously fetched throttle opening TH(OLD) which has been fetched before 30 msec is transferred to an area for storing old throttle opening data in the RAM. In step 951, the present throttle opening is fetched and converted in a digital signal and then stored in an area for storing new throttle opening data in the RAM. Next, in step 952, the presently fetched throttle opening TH is subtracted from the previously fetched throttle opening TH(OLD) to thereby obtain the throttle opening change rate $\Delta TH$. In step 953, the judgement is made whether the change rate $\Delta TH$ is larger than zero or not. If the judgement proves to be $\Delta TH \leqq 0$, the presently fetched throttle opening TH is stored in a pregiven area for storing an initial opening in the RAM as an initial throttle opening THo in place of the previously stored initial opening. If the judgement proves to be $\Delta TH > 0$, i.e., to be in an acceleration state, the judgement is made whether the initial throttle opening THo stored in the RAM is not less than a pregiven threshold value $\alpha$ or not in step 954. This initial throttle opening THo shows a throttle opening upon the start of acceleration. If the judgement proves to be $THo > \alpha$, i.e., the initial throttle opening THo belongs to a first opening range, it is determined that the acceleration starts from a partially opened opening position of the throttle valve. Thus, in step 955, the compensation factor K is calculated on the basis of the throttle opening change rate $\Delta TH$ obtained in step 952, the additional fuel injection amount $T_0$ is obtained on the basis of the obtained compensation factor K, and then the additional injection amount of the first opening range is injected. Hereinafter, the amount $T_0$ is obtained on the basis of the compensation factor K calculated in accordance with the opening change rate $\Delta TH$.

If the judgement proves to be $THo \leqq \alpha$ in step 954, i.e., the initial throttle opening THo belongs to a second opening range, it is determined that the acceleration starts from a small opening position or an idle position of the throttle valve. Thus, in step 956, the compensation factor K is claculated on the basis of the throttle opening change rate $\Delta TH$ obtained in step 952 and then the factor K is multiplied by $n(n>1)$. Further, the additional fuel injection amount $T_0$ is obtained on the basis of the obtained compensation factor nK, and then the additional injection amount of the second opening range is injected. Hereinafter, the amount $T_0$ is obtained on the basis of the compensation factor nK. Thus, since the additional fuel injection amount $T_0$ in the second opening range is modified to be larger than the amount $T_0$ in the first opening range, the fuel air mixture is prevented from being lean near the start of acceleration when the initial throttle opening is small.

The flowchart of FIG. 24 may be modified in a manner that the initial throttle opening is divided into a plurality of ranges with respect to a plurality of threshold levels and the compensation factor K may be modified in accordance with the range to which the initial throttle opening belongs. Such a flowchart is shown in FIG. 25. This flowchart is executed every 10 msec.

In FIG. 25, steps shown by the same reference numerals of FIG. 24 perform same processes of the steps of FIG. 24, and so the explanation of the steps are eliminated. In this embodiment, the initial throttle opening THo is divided into four ranges, for example, with respect to three threshold levels $\alpha_1$, $\alpha_2$ and $\alpha_3$ ($\alpha_1 < \alpha_2 < \alpha_3$).

In step 960, the judgement is made whether the initial opening THo is not less than $\alpha_1$ or not. If the judgement proves to be $THo < \alpha_1$, i.e., the opening THo belongs to a fourth opening range, it is determined that the acceleration starts from the smallest throttle opening position or an idle position of the throttle valve. Thus, in step 968, the compensation factor K is calculated on the basis of the throttle opening change rate $\Delta TH$ obtained in step 952 and then the factor K is multiplied by $n_4$. Further, the additional fuel injection amount $T_0$ is obtained on the basis of the obtained compensation factor $n_4K$, and then the additional injection amount of the fourth opening range is injected.

If the judgement proves to be $THo \geqq \alpha_1$, in step 960, the judgement is made whether the initial throttle opening THo is not less than $\alpha_2$ in step 962. If the judgement proves to be $THo < \alpha_2$, i.e., the initial opening THo belongs to a third opening range, in step 970 the compensation factor K calculated on the basis of the throttle opening change rate $\Delta TH$ is multiplied by $n_3$. Further, the additional injection amount $T_0$ is obtained on the basis of the compensation factor $n_3K$ to thereby inject the additional injection amount $T_0$ in the third opening range.

If the judgement proves to be $THo \geqq \alpha_2$, in step 962, the judgement is made whether the initial throttle opening THo is not less than $\alpha_3$ in step 964.

If the judgement proves to be $THo < \alpha_3$, i.e., the initial opening THo belongs to a second opening range, in step 972 the compensation factor K calculated on the basis of the throttle opening change rate $\Delta TH$ is multiplied by $n_2$. Further, the additional injection amount $T_0$ is obtained on the basis of the compensation factor $n_2K$ to thereby inject the additional injection amount $T_0$ in the second opening range.

If the judgement proves to be $THo \geqq \alpha_3$, i.e., the initial opening THo belongs to a first opening range, in step 966 the compensation factor K calculated on the basis of the throttle opening change rate $\Delta TH$ is multiplied by $n_1$. Further, the additional injection amount $T_0$ is obtained on the basis of the compensation factor $n_1K$ to thereby inject the additional injection amount $T_0$ in the first opening range.

Now, the factor $n_1 - n_4$ has such a relation as $n_1 < n_2 < n_3 < n_4$. Thus, the additional fuel injection amount $T_0$ with respect to a given throttle opening change rate increases with the decrease of the initial throttle opening THo, so that the fuel air mixture is prevented from being lean near the start of acceleration when the initial throttle opening is small.

Now, in the embodiments of each of FIGS. 24 and 25, the compensation factor K may be calculated on the basis of the maximum value among the throttle opening change rates which has been obtained so as to prevent the fuel air ratio from being lean near the end of acceleration.

Further, in any embodiments, the compensation factor K may be modified in accordance with the engine cooling water temperature.

The additional fuel injection amount may be obtained from a map.

Referring to FIGS. 26 to 28, the INTV interruption processing will be now described. FIG. 26 shows a soft timer table which is provided in the RAM 106 and which is provided with timer blocks in the same number as that of different activation periods activated by various kinds of interruptions. The term "timer block" is defined as a storage area into which time information with respect to the activation period of the task stored in the ROM 104. In FIG. 26, "TMB" described at the left end represents the head address of the soft timer table in the RAM 106. Into each of the timer blocks of the soft timer table, the time information with respect to the above-mentioned activation period is stored from the ROM 104 in starting the engine. That is, when the INTV interruption is performed, for example, at a regular period of time of 10 msec, a value which is integral multiples of 10 msec and which represents the respective activation period is transferred and stored in the respective timer block.

FIG. 27 shows a flowchart for executing the INTV interruption processing 606. In FIG. 27, if the program is activated at a step 626, the soft timer table provided in the RAM 106 is initialized in a step 628. That is, the contents i of the index register is made 0 (zero) and the residual timer $T_1$ stored in the time block of the address TMB+0 in the timer table is checked. In this case $T_1=T_0$. Next, judgement is made in a step 630 as to whether the soft timer checked in the step 628 is in the state of stoppage or not. That is, when the residual time $T_1$ stored in the soft timer table is 0 (zero), the judgement is concluded that the soft timer is in the state of stoppage and that the corresponding task to be activated by the specific soft timer is in the state of stoppage, so that processing is jumped to a step 640 in which the soft timer table is renewed. That is, the above-mentioned judgement is made on the basis of the fact that when the task is stopped, the residual timer is left it as it is without being initialized when it becomes 0 (zero).

In the case where the residual timer $T_1=0$, the processing is shifted to a step 632 in which the residual timer in the time block is renewed. In particular, the residual timer $T_1$ is decremented by 1 (one). Next, judgement is made in a step 634 as to whether the soft timer has reached the activation period or not. When the residual timer $T_1=0$, the judgement is concluded that the activation period has been reached and the processing is shifted to a step 636. If the judgement is concluded that the soft timer has not reached the activation period, on the contrary, the processing is jumped to the step 640 in which the soft timer table is renewed. When the soft timer table has reached the activation period, the residual time $T_1$ of the soft timer table is initialized in the step 636. That is, the timer information with respect to the activation period of the specific task is transferred from the ROM 104 to the RAM 106. After the residual timer $T_1$ of the soft timer table has been initialized in the step 636, an activation request for the task corresponding to the soft timer table is issued in a step 638. Then, the soft timer table is renewed in the step 640. That is, the contents of the soft timer table is incremented by 1 (one). Further judgement is made in a step 642 as to whether all the soft timers have been checked or not. That is, since (n+1) soft timer tables are provided in this embodiment as seen in FIG. 27, the judgement is concluded that all the soft timer tables have checked when the contents i of the index register is i=n+1 and the INTV interruption processing program 606 is terminated in a step 644. When the judgement is concluded in the step 642 that not all of the soft timer tables have been checked, on the contrary, the processing is returned back to the step 630 so that the above-mentioned processings are performed.

As described above, in accordance with various kinds of interruptions activation requests for specific tasks corresponding to the interruptions are issued and the specific tasks are executed in response to the activation requests. However, all the tasks listed up in Table 2 are not always executed, but pieces of time information with respect to activation periods of the respective tasks provided in the ROM 104 are selected on the basis of the running information as to the engine and the selected time information is stored in the RAM 106. Assuming that the activation period of a given task is, for example 20 msec, the task is activated at the regular period of time of 20 msec, and if the activation of the task is necessary to be continuously effected in accordance with the running condition of engine, the soft timer table corresponding to the specific task is always renewed so as to be initialized.

Next, the status in which the activation of tasks is stopped due to various interruptions in accordance with the running condition of the engine will be described by referring to the time chart of FIG. 28. Upon the actuation of the START-SW 152 (FIG. 5), the CPU 102 is actuated and "1" is set in each of the software flags IST and EM. The software flag IST is provided for indicating that the engine is in its pre-starting state and the software flag EM is provided for the inhibition of ENST interruption. In accordance with these two flags, judgement is made as to whether the engine is in its pre-starting state, in its starting state, or in its post-starting state. When the START-SW 152 is actuated to turn on power, the task ADIN1 is first activated so that the data, such as the cooling water temperature, the battery voltage, necessary for the starting of the engine are taken from the various sensors into the ADC 122 through the MPX 120, and every time all of this data has been successively inputted, the task HOSEI, that is, the compensation task, is activated so that compensation is computed on the basis of the inputted data. Further, every time all of the data from the various sensors has been successively inputted to the ADC 122 in accordance with the ADIN1, the task ISTRT is activated so that the fuel injection amount necessary in starting of the engine is computed. The above-mentioned three tasks, that is, the task ADIN1, the task HOSEI and the task ISTRT are activated in accordance with the initial processing program 202.

Upon the turning ON of the START-SW 152, the three tasks, that is, the task ADIN1, the task HOSEI and the task ISTRT are activated by the interruption signal of the task ISTRT. That is, these tasks have to be executed only in the period in which the START-SW 152 is in its ON state (in the period of cranking of the engine). In this period, pieces of time information with respect to the predetermined activation periods are transferred from the ROM 104 to the soft timer tables corresponding to the respective tasks provided in the RAM 106. Further, in this period, the residual time $T_1$ in the respective soft timer table is initialized and the setting of the activation period is repeatedly performed. Being provided for computing the fuel injection amount in the starting of the engine, the task MONIT becomes unnecessary after the engine starting, and therefore after the task has been executed a predetermined number of times, the activation of the soft timer is stopped and tasks necessary in the post-starting state of the engine other than the task MONIT are activated in response to a stop-page signal produced upon the termination of the task MONIT. In order to perform the stoppage of the task by the soft timer, "0" is stored in the soft timer table corresponding to the task in response to a signal indicating the termination of the task at the judgement point of time at the end of the task. That is, the stoppage of task is effected by clearing the contents of the soft timer corresponding to the task. Thus arrangement is made such that the stoppage of task activation can be simply attained by the soft timer and therefore a plurality of tasks having different activation periods from each other can be controlled effectively and reliably.

FIG. 29 shows an IRQ generating circuit. An INTV IRQ generating circuit is constituted by a register 735, a counter 736, a comparator 737, and a flip-flop 738, and a period for generating INTV IRQ, for example 10 msec, is set into the register 735. A clock pulse is set into the counter 736, and when the count of the counter 736 becomes coincident with the contents of the register 735, the flip-flop 738 is set. In this set state of the flip-flop 738. The counter 736 is cleared and the counting is restarted. Therefore, the INTV IRQ is generated at a predetermined regular interval of time (10 msec). An ENST IRQ generating circuit for detecting engine stoppage is constituted by a register 741, a counter 742, a comparator 743, and a flip-flop 744. The register 741, the counter 742 and the comparator 743 operate in the same manner as described above in the INTV IRQ generating circuit so that when the count of the counter 742 has reached the contents of the register 741, an ENST IRQ is generated. However, since the counter 742 is cleared by an REF pulse generated by a crank angle sensor at a predetermined interval of crank angles during the rotation of the engine, the count of the counter 742 can not reach the contents of the register 741 so that no ENST IRQ is generated.

An INTV IRQ generated by the flip-flop 738, an ENST IRQ generated by the flip-flop 744, and IRQs generated by the ADC1 and ADC2 are set into flip-flops 740, 746, 764, and 768 respectively. A signal for generating/inhibiting IRQ is set into each of flip-flops 739, 745, 762, and 766. If "H" is set in any one of the flip-flops 739, 745, 762, and 766, corresponding one of AND gates 748, 750, 770, and 772 is enabled so that an IRQ is immediately generated through an OR gate 751. Thus, an IRQ can be inhibited from generation, or released from inhibition by setting "H" or "L" into the respective flip-flops 739, 745, 762 and 766. The cause of generation of IRQ is removed by taking the contents of the flip-flops 740, 746, 764 and 768 into the CPU.

When the CPU begins to execute a program in response to an IRQ, it is necessary to delete the IRQ signal and therefore specific one of the flip-flops 740, 746, 764 and 768 concerned with the specific IRQ is cleared.

We claim:

1. A control apparatus for an internal combustion engine, comprising:

sensor means for producing signals representative of operating conditions of said engine, including throttle opening sensor means for detecting the opening of the engine throttle value;

actuator means for controlling respective energy conversion functions of said engine in response to control signals applied thereto, including a fuel injection for supplying fuel to said engine in response to a control signal applied thereto;

an input/output unit coupled to receive signals produced by said sensor means and to deliver control signals to said actuator means; and a data processing unit coupled to said input/output unit, including means for carrying out engine control data processing operations in accordance with signals produced by said sensor means and for thereby generating engine control codes that are coupled to said input/output unit for effecting application of said control signals to said actuator means;

said data processing unit including means for successively sampling output signals of said throttle opening sensor means with a predetermined interval through said input/output unit and calculating successive throttle opening change rates of said throttle value on the basis of the output signal of said throttle opening sensor means to thereby determine that said engine is in a period of acceleration as long as the calculated throttle opening change rate is positive;

said actuator means including means for controlling said fuel injector to supply a basic amount of fuel to said engine in a steady operation condition of said engine and to supply an additional amount of fuel in addition to said basic amount of fuel in response to the control signal from said input/output unit when an acceleration condition is detected by said data processing unit, and means for determining said additional amount of fuel in accordance with the calculated throttle opening change rate by always selecting the maximum one among the throttle opening change rates which have been detected during the period of acceleration and calculating the amount of additional fuel injection in accordance with the detected maximum throttle opening change rate, so as to prevent the additional fuel injection amount from being decreased near the end of the acceleration period.

2. A control apparatus according to claim 1, wherein said data processing unit further comprises means for determining a compensation factor for the additional fuel injection amount in accordance with the throttle opening change rate and for determining the additional fuel injection amount on the basis of the compensation factor, and means for modifying the compensation factor in accordance with an initial value of the throttle opening at the beginning of the acceleration period so as to prevent the fuel air mixture from being lean near the start of acceleration.

* * * * *